US007980682B2

(12) United States Patent
Kojima

(10) Patent No.: US 7,980,682 B2
(45) Date of Patent: Jul. 19, 2011

(54) LIQUID DROPLET DISCHARGE APPARATUS AND LIQUID DROPLET DISCHARGE HEAD

(75) Inventor: Masatomo Kojima, Ichinomiya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 304 days.

(21) Appl. No.: 12/286,231

(22) Filed: Sep. 29, 2008

(65) Prior Publication Data

US 2009/0085984 A1 Apr. 2, 2009

(30) Foreign Application Priority Data

Sep. 29, 2007 (JP) ..... 2007-256921

(51) Int. Cl.
*B41J 2/045* (2006.01)

(52) U.S. Cl. ..... 347/72

(58) Field of Classification Search ..... 347/72
See application file for complete search history.

(56) References Cited

U.S. PATENT DOCUMENTS

| | | | |
|---|---|---|---|
| 6,450,626 | B2 | 9/2002 | Ikeda et al. |
| 7,073,894 | B2 | 7/2006 | Isono et al. |
| 2002/0140784 | A1 | 10/2002 | Takahashi |
| 2003/0142173 | A1 | 7/2003 | Takahashi |
| 2005/0231073 | A1 | 10/2005 | Sugahara et al. |
| 2007/0222825 | A1 | 9/2007 | Takahashi |

FOREIGN PATENT DOCUMENTS

| | | |
|---|---|---|
| EP | 08017145.7 | 2/2009 |
| JP | 3396196 | 7/2001 |
| JP | 2002-019113 | 1/2002 |
| JP | 2002-254640 | 9/2002 |
| JP | 2005-059551 | 3/2005 |
| JP | 2005-317952 | 11/2005 |

*Primary Examiner* — Jerry T Rahll
(74) *Attorney, Agent, or Firm* — Frommer Lawrence & Haug LLP

(57) ABSTRACT

A piezoelectric actuator includes first active portion which correspond to a central portion of each of pressure chambers and a second active portion which correspond to a portion, of each of the pressure chambers, located on outer circumferential sides with respect to the central portion of the pressure chamber. The first active portion and the second active portion are deformed by applying the voltage to each of the first and second active portions. The first active portion is polarized in a direction parallel to the electric field generated in the first active portion, and the second active portion is polarized in a direction opposite to the electric field generated in the second active portion, thereby making it possible to suppress the crosstalk even when a high density arrangement of the pressure chambers is realized.

16 Claims, 15 Drawing Sheets

LIQUID DROPLET DISCHARGE APPARATUS AND LIQUID DROPLET DISCHARGE HEAD

CROSS REFERENCE TO RELATED APPLICATION

The present application claims priority from Japanese Patent Application No. 2007-256921, filed on Sep. 29, 2007, the disclosure of which is incorporated herein by reference in its entirety.

BACKGROUND OF THE INVENTION

1. Field of the Invention

The present invention relates to a liquid droplet discharge apparatus such as an ink-jet printer and a liquid droplet discharge head such as an ink-jet head.

2. Description of the Related Art

Conventionally, an ink-jet printer is known as one of liquid droplet discharge apparatuses, comprising an ink-jet head which is constructed by joining a cavity unit formed with a plurality of pressure chambers aligned regularly and a piezoelectric actuator for selectively discharging inks contained in the respective pressure chambers, and a voltage-applying means which applies the voltage to the piezoelectric actuator. Those known as the piezoelectric actuator as described above include those based on the use of the stacked type vertical effect actuator (see, for example, Japanese Patent Application Laid-open No. 2005-59551) and those based on the use of the unimorph actuator (see, for example, Japanese Patent Application Laid-open No. 2005-317952).

It is requested for the ink-jet head of the ink-jet printer as described above to arrange the pressure chambers at a high density in order to secure the high image quality and the high quality of the recording by increasing the number of nozzles. When the pressure chambers are arranged at a high density, the distance between the adjoining pressure chambers is shortened. Therefore, a problem of the so-called crosstalk arises such that the adjoining pressure chamber is affected during the driving.

As shown in FIGS. 13 and 14, for example, the ink-jet head has a cavity unit 914 which is formed with pressure chambers 940 arranged regularly, a constraint plate 915 which is arranged on the upper side of the cavity unit 914, and a piezoelectric actuator 912 which has three piezoelectric material layers 912*a*, 912*b*, 912*c*. The ink-jet head is formed by joining these components. An individual electrode 921 is provided on an upper surface side of the piezoelectric material layer 912*a* corresponding to each of the pressure chambers 940, and a constant electric potential electrode 922 (ground electric potential) is provided on a lower surface side thereof. Further, an individual electrode 921 is provided on an upper surface side of the piezoelectric material layer 912*c*, and a constant electric potential electrode 922 is provided on a lower surface side thereof. In the case of such an arrangement, when the positive electric potential is selectively applied to the individual electrodes 921, the areas of the piezoelectric material layers, which are interposed by the individual electrodes 921 and the constant electric potential electrodes 922, function as the active portions S to change the volume of the pressure chamber 940 so that the ink is discharged from a nozzle hole 914*b*. As shown in FIG. 15, the deformation, which is brought about in order to discharge the ink as described above, affects not only the pressure chamber which discharges the ink but also the pressure chamber 940 which is disposed adjacently to the concerning pressure chamber 940, due to the deformation of the piezoelectric material layers 912*a* to 912*c*.

For this reason, an inconvenience arises such that the discharge characteristic is varied in relation to the adjoining pressure chamber 940 (for example, an inconvenience arises such that the ink is unintentionally discharged from the nozzle hole 914*b*). That is, the problem of crosstalk arises.

In order to dissolve the problem of crosstalk as described above, various countermeasures have been suggested. For example, Japanese Patent Application Laid-open No. 2002-254640 (FIG. 2) describes a beam section 100 which is provided to range over between partition walls 11 disposed on the both sides in the widthwise direction of a pressure-generating chamber 12 so that the rigidity of the partition wall 11 is improved thereby to avoid the occurrence of any crosstalk between the adjoining pressure-generating chambers.

On the other hand, Japanese Patent Application Laid-open No. 2002-19113 (FIG. 1) describes an elastic member 7 which has a predetermined width and a predetermined depth from a nozzle plate 3 and which is arranged on a side wall 5 for comparting and isolating respective pressurizing liquid chambers 4 so that any mechanical crosstalk is decreased thereby.

However, the countermeasures as described above are not complete as well, as the high density of pressure chambers (ink discharge ch) is progressively increased. In other words, when the pressure chambers are arranged at a high density, it is difficult to avoid the crosstalk by means of the countermeasures as described above.

SUMMARY OF THE INVENTION

An object of the present invention is to provide a liquid droplet discharge apparatus and a liquid droplet discharge head which make it possible to suppress the crosstalk without increasing the number of individual electrodes, i.e., the number of signal lines even when a high density is realized.

According to a first aspect of the present invention, there is provided a liquid droplet discharge apparatus which discharges liquid droplets of a liquid, the liquid droplet discharge apparatus including:

a liquid droplet discharge head including a cavity unit which has a plurality of pressure chambers arranged regularly in the cavity unit and a piezoelectric actuator which is joined to the cavity unit and which selectively discharges the liquid in each of the pressure chambers, the piezoelectric actuator having a piezoelectric material layer which covers the pressure chambers, and the piezoelectric material layer including a first active portion which corresponds to a central portion of each of the pressure chambers and a second active portion which corresponds to a portion, of each of the pressure chambers, located on an outer circumferential side with respect to the central portion of each of the pressure chambers; and a voltage-applying mechanism which applies a voltage to the first active portion and applies a voltage to the second active portion;

wherein the first active portion is polarized in a direction which is same as a direction of an electric field generated by the voltage applied to the first active portion, and the second active portion is polarized in a direction which is opposite to the direction of an electric field generated by the voltage applied to the second active portion. The term "active portion" herein means a portion of the piezoelectric material layer, wherein the portion is deformed when the voltage is applied, and the portion is not deformed when the voltage is not applied. The term "second active portion" may range over or cover a portion which corresponds to each of the pressure chambers and a portion which corresponds to a column portion disposed between adjacent pressure chambers among the plurality of pressure chambers. Alternatively, the "second active portion" may exist only at a portion which corresponds to the column portion and shifted or away from the portion corresponding to the pressure chamber. Further alternatively, the "second active portion" may exist only at a portion which corresponds to the pressure chamber. The term "predetermined direction" means a direction in which the pressure chamber and the active portion are aligned, i.e., the stacking direction of the piezoelectric actuator and the cavity unit.

According to the first aspect of the present invention, the deformation is generated in the opposite directions by applying the voltage in the first active portion which corresponds to the central portion of the pressure chamber and the second active portion which corresponds to the portion, of the pressure chamber, located on the outer circumferential side as compared with or with respect to the central portion of the pressure chamber. Even when the pressure chambers are arranged at a high density, and the mutually adjacent pressure chambers are arranged closely to each other, the deformation of the first active portion, which is brought about to discharge the liquid in a certain pressure chamber among the pressure chambers, is canceled by the deformation of the second active portion when the deformation of the first active portion is propagated to another pressure chamber adjacent to the certain pressure chamber. Accordingly, the so-called crosstalk, in which the deformation of the first active portion of a certain pressure chamber is propagated to adjacent pressure chamber or chambers, is suppressed. It is also unnecessary to control the timing highly accurately in order to cancel the crosstalk.

According to a second aspect of the present invention, there is provided a liquid droplet discharge apparatus which discharges liquid droplets of a liquid, the liquid droplet discharge apparatus including:

a liquid droplet discharge head including a cavity unit which has a plurality of pressure chambers arranged regularly in the cavity unit and a piezoelectric actuator which is joined to the cavity unit and which selectively discharges the liquid in each of the pressure chambers, the piezoelectric actuator having a piezoelectric material layer which covers the pressure chambers, a plurality of individual electrodes which correspond to the pressure chambers respectively, and first and second constant electric potential electrodes which correspond to each of the pressure chambers, and the piezoelectric material layer including a first active portion which is sandwiched by one of the individual electrodes and the first constant electric potential electrode and which corresponds to a central portion of each of the pressure chambers and a second active portion which is sandwiched by one of the individual electrodes and the second constant electric potential electrode and which corresponds to a portion, of each of the pressure chambers, located on an outer circumferential side with respect to the central portion of each of the pressure chambers; and a voltage-applying mechanism which applies a voltage to the piezoelectric actuator;

wherein the first active portion is polarized in a predetermined direction along with a stacking direction of each of the individual electrodes and the first constant electric potential electrode;

the second active portion is polarized in a direction opposite to the predetermined direction along with the stacking direction of each of the individual electrodes and the second constant electric potential electrode; and the voltage-applying mechanism selectively applies, to the individual electrodes, a first electric potential and a second electric potential different from the first electric potential; and the voltage-applying mechanism applies the first electric potential to the first and second constant electric potential electrodes.

According to the second aspect of the present invention, when the deformation of the first active portion to discharge the liquid in a certain pressure chamber among the pressure chambers is propagated to another pressure chamber adjacent to the certain pressure chamber in a situation in which the second electric potential is applied to the individual electrode to discharge the liquid, then the deformation of the second active portion to cancel the propagation is brought about simultaneously with the deformation of the first active portion. Accordingly, the deformation of the first active portion, which attempts to propagate to the adjoining pressure chamber, is counteracted by the deformation of the second active portion, thereby suppressing the crosstalk.

In the liquid droplet discharge apparatus of the present invention, a spacing distance between each of the individual electrodes and the second constant electric potential electrode to sandwich the second active portion therebetween may be greater than a spacing distance between each of the individual electrodes and the first constant electric potential electrode to sandwich the first active portion therebetween.

In this case, the spacing distance between the individual electrode and the second constant electric potential electrode to sandwich or interpose the second active portion therebetween is greater than the spacing distance between the individual electrode and the first constant electric potential electrode to sandwich the first active portion therebetween. Therefore, when the voltage is applied to each of the first and second active portions in the predetermined direction, the second active portion, which is polarized in the direction opposite to the predetermined direction, has a low electric field intensity as compared with the first active portion which is polarized in the predetermined direction. This is advantageous to avoid the polarization deterioration at the second active portion.

In the liquid droplet discharge apparatus of the present invention, the piezoelectric material layer may include two piezoelectric sheets which are stacked and which have different thicknesses.

In this case, the thin piezoelectric sheet can be utilized as the insulating layer. Therefore, the first constant electric potential electrode and the second constant electric potential electrode can be formed in a state of being reliably isolated from each other. Therefore, the electrodes can be formed while narrowing the spacing distance between the electrodes as compared with a case that the electrodes are formed on a same surface.

In the liquid droplet discharge apparatus of the present invention, the piezoelectric sheets may include an upper piezoelectric sheet and a lower piezoelectric sheet thinner than the upper piezoelectric sheet, the upper piezoelectric sheet being stacked onto the lower piezoelectric sheet; and the second constant electric potential electrode may be arranged between the upper piezoelectric sheet and the lower piezoelectric sheet, and the first constant electric potential electrode may be arranged at a position below the lower piezoelectric sheet.

In this case, the first constant electric potential electrode and the second constant electric potential electrode are isolated from each other while sandwiching the lower piezoelectric sheet which serves as the insulating layer. Therefore, even when the first constant electric potential electrode and the second constant electric potential electrode are formed closely by utilizing the lower piezoelectric sheet, the electrodes form no short circuit. Therefore, the first active portion and the second active portion can be arranged closely, and this is advantageous to realize a compact size.

In the liquid droplet discharge apparatus of the present invention, the piezoelectric material layer may have another piezoelectric sheet which is different from the two piezoelectric sheets; the stacked two piezoelectric sheets may be thinner than the another piezoelectric sheet; and each of the individual electrodes may be arranged on an upper piezoelectric sheet among the two piezoelectric sheets, the second constant electric potential electrode may be arranged between the two piezoelectric sheets, and the first constant electric potential electrode may be arranged at a portion below the lower piezoelectric sheet.

In this case, the individual electrode, the first constant electric potential electrode, and the second constant electric potential electrode can be formed while being isolated from each other, by utilizing the two piezoelectric sheets as the insulating layers. Therefore, even when the electrodes are formed closely, they form no short circuit. Therefore, the individual electrode, the first active portion, and the second active portion can be arranged closely, and this is advantageous to realize a compact size.

In the liquid droplet discharge apparatus of the present invention, the second constant electric potential electrode may be arranged corresponding to a column portion between adjacent pressure chambers among the plurality of pressure chambers, the column portion being located at the outside of an outer circumferential edge of each of the pressure chambers.

In this case, even when the second active portion, which corresponds to the second constant electric potential electrode, is deformed, there is no contribution to the volume change of the pressure chamber, but the effect to suppress the crosstalk is exhibited.

In the liquid droplet discharge apparatus of the present invention, the second active portion may include an area located inside an outer circumferential edge of each of the pressure chambers.

In this case, not only the deformation of the first active portion but also the deformation of the second active portion contributes to the volume change of the pressure chamber. The volume of the pressure chamber can be changed more greatly than a case that only the deformation of the first active portion is caused. Therefore, it is possible to improve the discharge efficiency (discharge amount to be brought about when the voltage is applied) to selectively discharge the liquid in the pressure chambers, by applying the voltage to the piezoelectric actuator.

In the liquid droplet discharge apparatus of the present invention, the piezoelectric material layer may have first, second, and third piezoelectric sheets which are stacked in this order; each of the individual electrodes may have a first individual electrode which is arranged on an upper surface of the first piezoelectric sheet and a second individual electrode which is arranged between the second and third piezoelectric sheets; the first constant electric potential electrode may have a first electrode section which is arranged between the first and second piezoelectric sheets corresponding to each of the pressure chambers and a second electrode section which is arranged under or below the third piezoelectric sheet; and the second constant electric potential electrode may be formed under or below the third piezoelectric sheet corresponding to each of the pressure chambers.

In this case, the three piezoelectric sheets are allowed to intervene in the second active portion between the second constant electric potential electrode and the first electrode section of the first constant electric potential electrode. Therefore, it is possible to increase the thickness of the second active portion, and it is possible to suppress the electric field gradient applied to the second active portion to be small. Therefore, there is no fear of the occurrence of any polarization breakdown which would be otherwise caused in the second active portion.

In the liquid droplet discharge apparatus of the present invention, the first and second individual electrodes may be electrically connected by a conductive material charged or filled into through-holes formed through the first and second piezoelectric sheets; and the first and second electrode sections of the first constant electric potential electrode may be electrically connected by the conductive material charged or filled into through-holes formed through the second and third piezoelectric sheets. In this case, the through-holes, which are formed through the piezoelectric sheets, are filled with the conductive material. Therefore, it is possible to reliably make conduction for the first and second individual electrodes (first and second electrode sections of the first constant electric potential electrode).

In the liquid droplet discharge apparatus of the present invention, the piezoelectric material layer may further include a fourth piezoelectric sheet which is stacked under or below the third piezoelectric sheet and which is thinner than the first to third piezoelectric sheets; and the second electrode section may be arranged on one surface of the fourth piezoelectric sheet, and the second constant electric potential electrode may be arranged on the other surface of the fourth piezoelectric sheet. In this case, the second electrode section and the second constant electric potential electrode are formed on the different surfaces of the fourth piezoelectric sheet respectively. Therefore, there is no fear of any electric conduction of the electrodes. Further, the fourth piezoelectric sheet is thinner than the first to third piezoelectric sheets. Therefore, it is unnecessary to excessively thicken the thickness of the piezoelectric actuator.

In the liquid droplet discharge apparatus of the present invention, the second active portion, which correspond to each of the pressure chambers, may be arranged to be on both sides of each of the pressure chambers. Alternatively, the second active portion, which corresponds to each of the pressure chambers, may be arranged on only one side of each of the pressure chambers. In any case, the second active portion is deformed in the direction opposite to the first active portion, and thus it is possible to suppress the deformation of the first active portion corresponding to a certain pressure chamber from being propagated to the first active portion corresponding to another pressure chamber.

According to a third aspect of the present invention, there is provided a liquid droplet discharge head which discharges liquid droplets of a liquid, the liquid droplet discharge head comprising:

a cavity unit which has a plurality of pressure chambers arranged regularly in the cavity unit; and a piezoelectric actuator which is joined to the cavity unit and which selectively discharges the liquid in each of the pressure chambers, the piezoelectric actuator including:

a piezoelectric material layer which covers the pressure chambers, the piezoelectric material layer having a first active portion which corresponds to a central portion of each of the pressure chambers and a second active portion which corresponds to a portion, of each of the pressure chambers, located on an outer circumferential side with respect to the central portion of each of the pressure chambers;

an individual electrode which is formed to cover an area, of the piezoelectric material layer, corresponding to the first active portion and an area, of the piezoelectric material layer, corresponding to the second active portion so that both of the areas are occupied by the individual electrode;

a first constant electric potential electrode which is formed to occupy the area of the piezoelectric material layer corresponding to the first active portion; and a second constant electric potential electrode which is formed to occupy the area of the piezoelectric material layer corresponding to the second active portion;

wherein the first active portion is polarized in a direction directed from the individual electrode to the first constant electric potential electrode, and the second active portion is polarized in a direction directed from the second constant electric potential electrode to the individual electrode.

According to the third aspect of the present invention, the first active portion corresponding to the central portion of each of the pressure chambers and the second active portion corresponding to the portion of the pressure chamber located on the outer circumferential side with respect to the central portion of the pressure chamber can be constructed so that the deformations of the first and second active portions are caused in the opposite directions (the direction opposite to the direction of the electric field) by applying the voltage. Therefore, it is possible to suppress the crosstalk which would be otherwise caused such that the deformation of the first active portion of a certain pressure chamber is propagated to another pressure chamber adjacent to the certain pressure chamber.

In the present invention, the deformation is caused in the opposite directions in the first active portion which corresponds to the central portion of the pressure chamber and the second active portion which corresponds to the portion located on the outer circumferential side as compared with the central portion of the pressure chamber. Therefore, even when the pressure chambers are arranged at a high density, the deformation of the first active portion is canceled by the deformation of the second active portion, when the deformation of the first active portion is propagated to the adjoining pressure chamber, thereby making it possible to suppress the crosstalk.

DESCRIPTION OF THE PREFERRED EMBODIMENTS

Embodiments of the present invention will be explained below with reference to the drawings.

First Embodiment

Figure 1A:
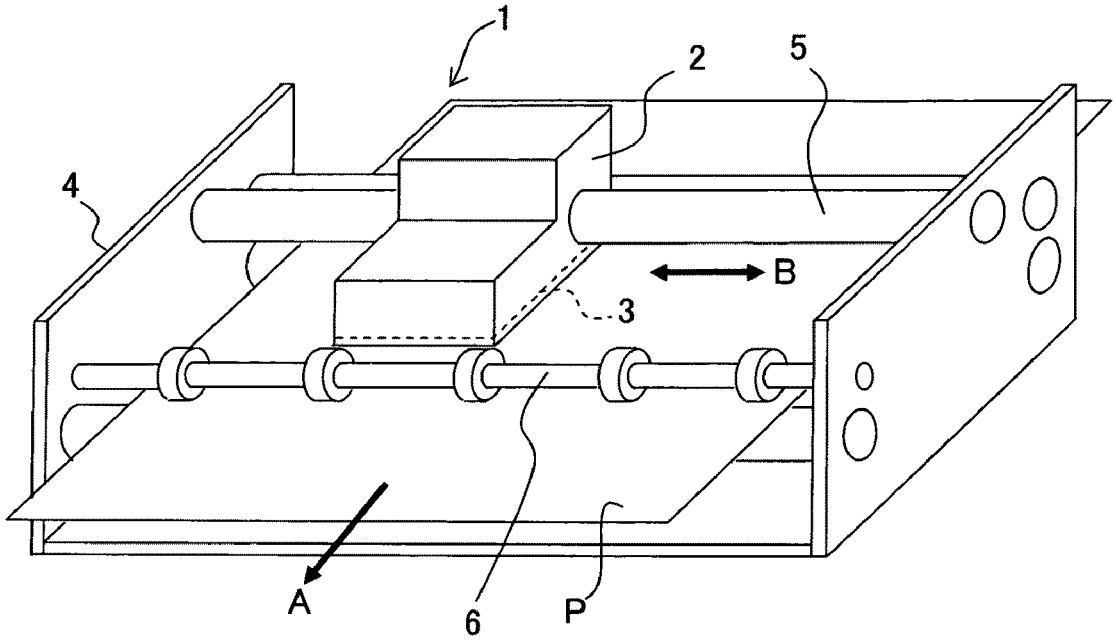
FIG. 1A shows a schematic construction of an ink-jet printer (liquid droplet discharge apparatus) according to the present invention.
Figure 1B:
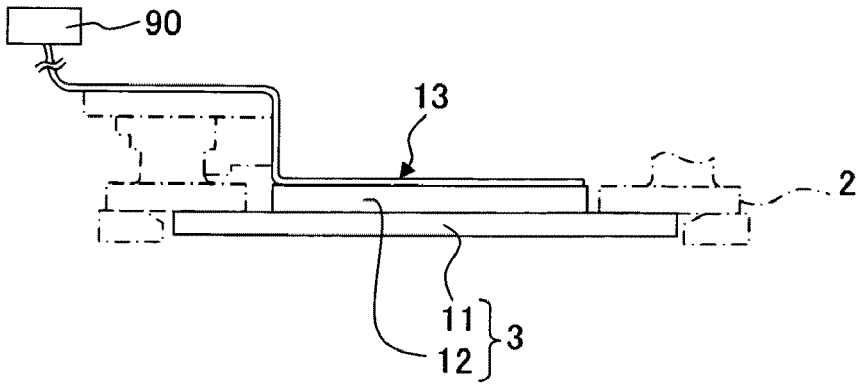
FIG. 1B illustrates the relationship among a cavity unit, a piezoelectric actuator, and a flexible wired board (COF) according to the present invention.

FIG. 1A shows a schematic construction of an ink-jet printer (liquid droplet discharge apparatus) according to the present invention, and FIG. 1B illustrates the relationship among a cavity unit, a piezoelectric actuator, and a flexible wired board (COF) according to the present invention.

As shown in FIG. 1A, the ink-jet printer 1 according to the present invention has an ink-jet head 3 (liquid droplet discharge head) for performing the recording on the recording paper P (recording medium), the ink-jet head 3 (liquid droplet discharge head) being provided on a lower surface of a carriage 2 on which ink cartridges (not shown) are carried. The carriage 2 is supported by a guide plate (not shown) and a carriage shaft 5 provided in a printer frame 4. The carriage 2 performs the reciprocating movement in the direction B perpendicular to the transport direction A of the recording paper P. The recording paper P, which is transported in the direction A from an unillustrated paper feed section, is introduced into the space between a platen roller (not shown) and the ink-jet head 3. Predetermined recording is performed with inks discharged from the ink-jet head 3 toward the recording paper P. The recording paper P is thereafter discharged by a paper discharge roller 6.

As shown in FIG. 1B, the ink-jet head 3 is provided with the cavity unit 11 and the piezoelectric actuator 12 which are arranged in this order from the lower side. The flexible wired board 13 (signal lines), which supplies the driving signal from a driving circuit 90, is provided on the upper surface of the piezoelectric actuator 12.

Figure 2A:
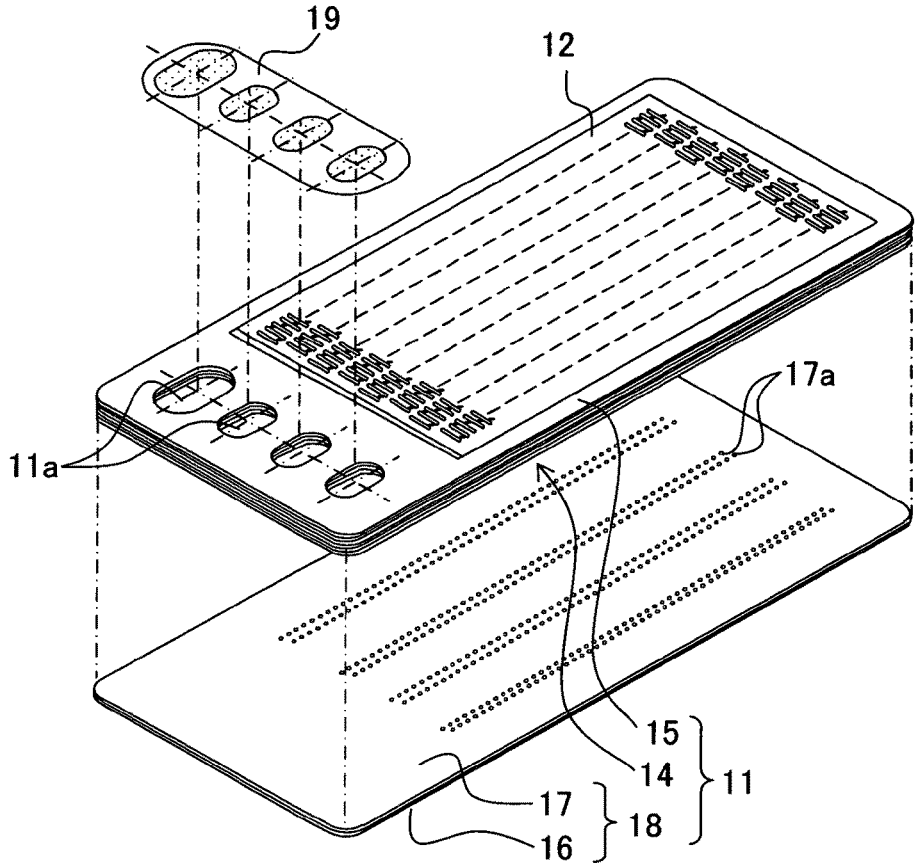
FIGS. 2A and 2B show perspective views illustrating that the piezoelectric actuator is stuck to the upper side of the cavity unit.
Figure 2B:
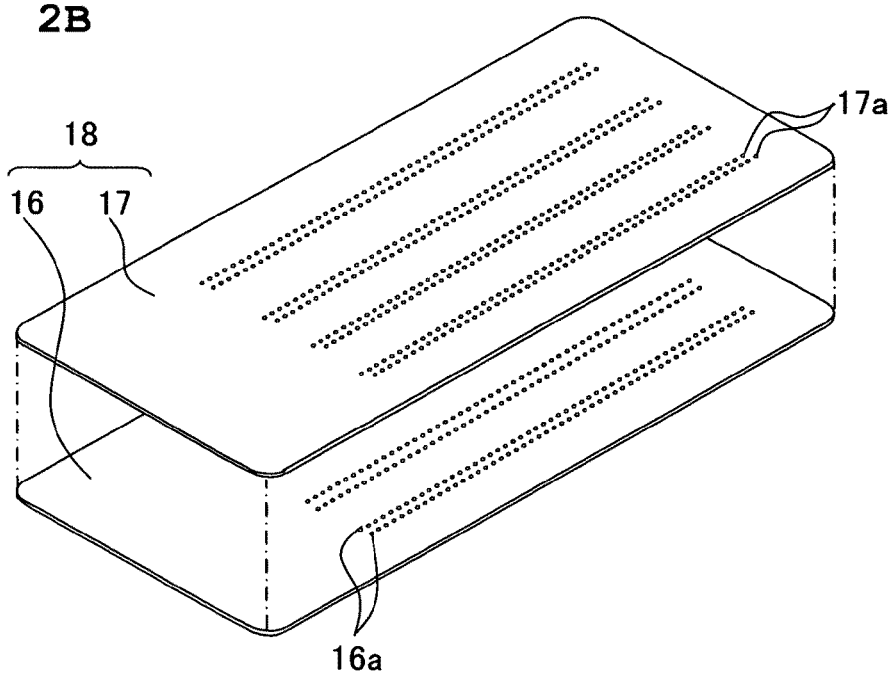

As shown in FIG. 2, the cavity unit 11 includes a stack 14 which is composed of a plurality of plate members. A top plate 15 is provided on the upper side of the stack 14. A plate assembly 18, which is constructed by sticking a nozzle plate 16 having nozzle holes 16*a* and a spacer plate 17 having through-holes 17*a* corresponding to the nozzle holes 16*a*, is integrally stuck on the lower side of the stack 14. The piezoelectric actuator 12, which is provided to selectively discharge the ink (liquid) contained in each of the pressure chambers 40, is joined on the upper side of the top plate 15. A filter 19 is provided on openings 11*a* of the cavity unit 11 in order to capture the dust or the like contained in the ink. The nozzle plate 16 is a plate made of synthetic resin (for example, polyimide resin) in which one nozzle hole 16*a* is provided for each one pressure chamber 40 of a cavity plate 14A (for constructing the stack 14). The nozzle plate 16 may be a metal plate.

Figure 3:
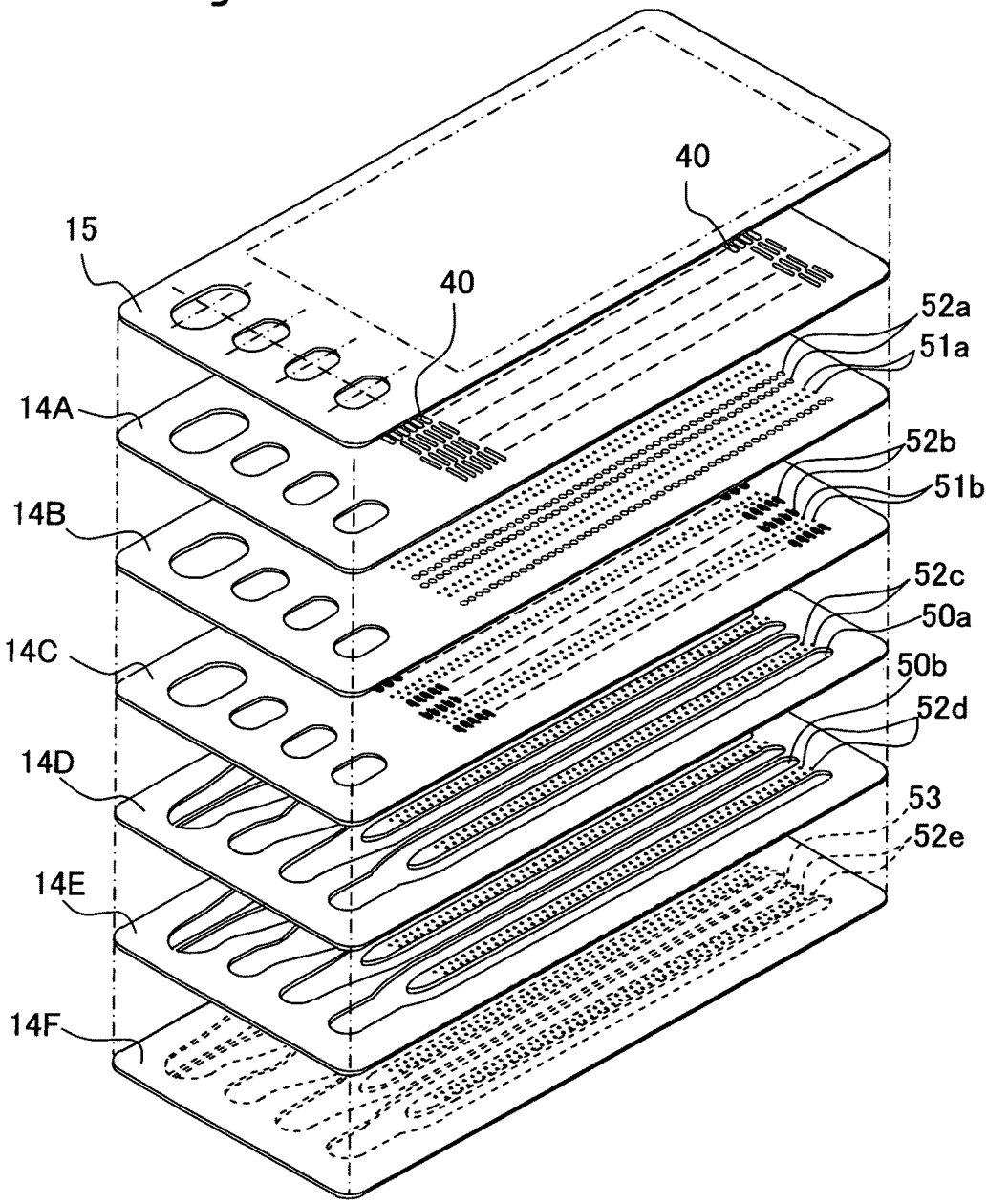
FIG. 3 shows the cavity unit disassembled into respective plates as constitutive elements, wherein they are depicted together with a top plate.

As shown in FIG. 3, the stack 14 includes the cavity plate 14A, a base plate 14B, an aperture plate 14C, two manifold plates 14D, 14E, and a damper plate 14F which are disposed in this order from the upper side, the plates being laminated and joined by means of the metal diffusion bonding respectively. The six plates 14A to 14F are stacked while being positionally adjusted to one another so that ink flow passages are individually formed for the respective nozzle holes 16*a*. In this case, the cavity plate 14A is a metal plate having openings which function as the plurality of pressure chambers 40 and which are formed regularly corresponding to the nozzle arrays. The base plate 14B is a metal plate provided with communication holes 51*a* which constitute parts of communication holes 51 for making communication between manifolds 50 (common ink chambers) described later on and the respective pressure chambers 40 and communication holes 52*a* which constitute parts of communication holes 52 for making communication between the respective pressure chambers 40 and the respective nozzle holes 16*a* respectively. Communication passages 21, which make communication between the respective pressure chambers 40 and the manifolds 50, are formed as recessed passages on the upper surface of the aperture plate 14C. Further, the aperture plate 14C is a metal plate provided with communication holes 51*b* which constitute parts of the communication holes 51 and communication holes 52*b* which constitute parts of the communication holes 52 respectively. The manifold plates 14D, 14E are formed with communication holes 50*a*, 50*b* which define the manifolds 50 respectively. Further, the manifold plates 14D, 14E are metal plates provided with communication holes 52*c*, 52*d* which constitute parts of the communication holes 52 respectively. The damper plate 14F is a metal plate provided with communication holes 52*e* which constitute parts of the communication holes 52 in addition to damper chambers 53 formed as recesses on the lower surface.

As described above, the cavity unit 11 is constructed to include the plurality of nozzle holes 16*a*, the plurality of pressure chambers 40 which are communicated with the plurality of nozzle holes 16*a* respectively, and the manifolds 50 which temporarily store the ink to be supplied to the pressure chambers 40. The communication holes 51*a*, 51*b* are communicated with each other to form the communication holes 51 which make communication between the pressure chambers 40 and the manifolds 50. Further, the communication holes 52*a* to 52*e* are communicated with each other to form the communication holes 52 which make communication between the pressure chambers 40 and the nozzle holes 16*a*.

Figure 4:
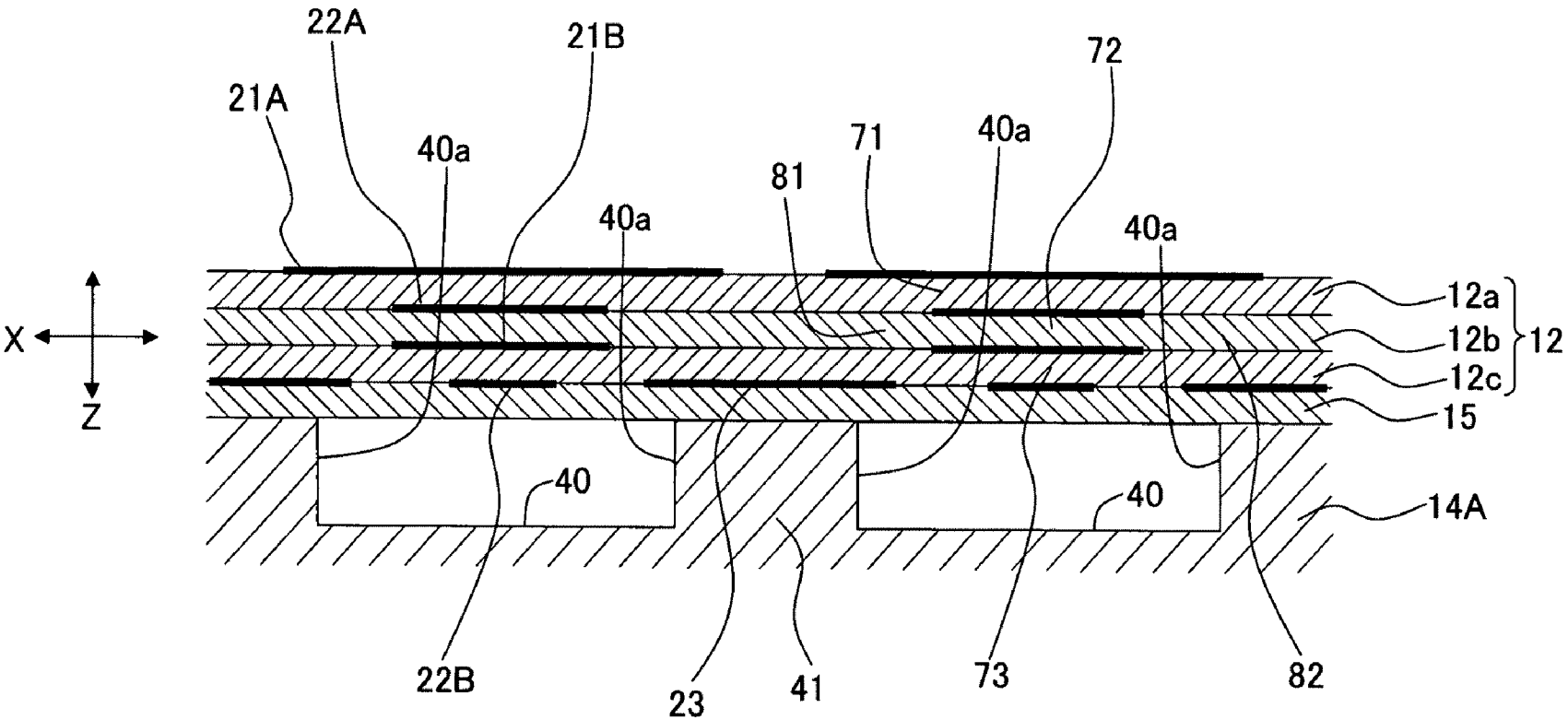
FIG. 4 shows a schematic sectional view illustrating a first embodiment.

As shown in FIG. 4, the piezoelectric actuator 12 is formed by stacking a plurality of piezoelectric sheets 12*a*, 12*b*, 12*c* which constitute the piezoelectric material layers. Each of the piezoelectric sheets 12*a* to 12*c* is composed of a ceramics material (piezoelectric sheet) based on lead titanate zirconate (PZT) having the ferroelectricity, which is polarized in the thickness direction (see FIG. 5).

When the pressure chamber 40 is viewed in a plan view (when the pressure chamber 40 is viewed in the stacking direction of the cavity unit 11 and the piezoelectric actuator 12), the piezoelectric actuator 12 is provided with first active portions 71, 72, 73 which correspond to the central portion of the pressure chamber 40 and second active portions 81, 82 which correspond to the left and right portions disposed on the outer circumferential sides as compared with the central portion of the pressure chamber 40. In this case, as shown in FIG. 4, the first active portions 71, 72, 73 correspond to the piezoelectric sheets 12*a*, 12*b*, 12*c* respectively, and the second active portions 81, 82 correspond to the left side and the right side of the pressure chamber 40 respectively. The central portion of the pressure chamber 40 is the central portion in the nozzle array direction X in which nozzle holes 16*a* are arranged.

The second active portions 81, 82 include not only the areas which correspond to column portions 41 as walls for comparting the adjoining pressure chambers 40 but also the areas which correspond to inner portions (disposed on the sides of the central portion) as compared with outer circumferential edges 40*a* of the pressure chambers 40.

The first active portions 71 to 73 reside in the area of the piezoelectric sheet 12*a* disposed between the individual electrode 21A and the first constant electric potential electrode 22A, the area of the piezoelectric sheet 12*b* disposed between the first constant electric potential electrode 22A and the individual electrode 21B, and the area of the piezoelectric sheet 12*c* disposed between the individual electrode 21B and the first constant electric potential electrode 22B respectively. On the other hand, both of the second active portions 81, 82 reside in the areas of the piezoelectric sheets 12*a* to 12*c* disposed between the individual electrode 21A and the second constant electric potential electrodes 23. Each of the electrodes 21A, 21B, 22A, 22B is composed of a metal material including, for example, those based on Ag—Pd.

A driving IC 90 (see FIG. 1B), which is the driving circuit for supplying the driving signal, is electrically connected to each of the individual electrodes 21A via the flexible wired board 13 (signal lines). The driving IC 90 and the flexible wired board 13 constitute the voltage-applying mechanism which applies the driving voltage to the piezoelectric actuator 12 (first active portions 71 to 73 and second active portions 81, 82).

In other words, in order to change the volume of the pressure chamber 40, the first electric potential (ground electric potential) and the second electric potential (for example, 20V) different therefrom are selectively applied to the individual electrodes 21 by the aid of the flexible wired board 13 as described later on. The first electric potential is always applied to the first constant electric potential electrodes 22A, 22B and the second constant electric potential electrode 23.

As described above, the piezoelectric actuator 12 has the individual electrodes 21A, 21B corresponding to the respective pressure chambers 40. When the first electric potential and the second electric potential are selectively applied as the driving signals to the individual electrodes 21A, 21B, the piezoelectric actuator 12 changes the volume of the pressure chamber 40 to discharge the ink from the nozzle hole 16*a*.

This feature will be described in further detail below. That is, the individual electrode 21A is formed such that the individual electrode 21A is longer than the pressure chamber 40 in the nozzle array direction X, the individual electrode 21A is shorter than the pressure chamber 40 in the direction Y perpendicular to the nozzle array direction X, and the individual electrode 21A ranges over the area corresponding to the first active portions 71 to 73 and the areas corresponding to the second active portions 81, 82 to occupy both of the areas. The individual electrode 22B, which is positioned on the side of the pressure chamber 40, is formed such that the individual electrode 22B is shorter than the individual electrode 21A in the nozzle array direction X, the individual electrode 21A being positioned separately from the pressure chamber 40.

The first constant electric potential electrodes 22A, 22B are formed such that the first constant electric potential electrodes 22A, 22B are shorter than the pressure chamber 40 in the nozzle array direction X to occupy the area corresponding to the first active portions 71 to 73. The first constant electric potential electrode 22B, which is positioned on the side of the pressure chamber 40, is formed to be shorter than the first constant electric potential electrode 22A in the nozzle array direction X, the first constant electric potential electrode 22A being positioned separately from the pressure chamber 40.

The second constant electric potential electrode 23 is formed to occupy the areas corresponding to the second active portions 81, 82 and the area corresponding to the column portion 41 disposed between the adjoining pressure chambers 40 in the direction perpendicular to the nozzle array direction. In other words, the second constant electric potential electrode 23 extends to the areas corresponding to the side portions of the pressure chambers 40 in the nozzle array direction, including the area corresponding to the column portion 41, and the second constant electric potential electrode 23 is shared by the adjoining two pressure chambers 40 in the nozzle array direction of the pressure chambers 40.

The individual electrode 21A is shared by the first and second constant electric potential electrodes 22A, 22B, 23.

Specifically, the electrodes are arranged as follows. That is, the individual electrode 21A is formed on the side of one surface (surface disposed on the upper side as shown in FIG. 4) of the piezoelectric sheet 12*a* disposed most separately from the pressure chamber 40, and the first constant electric potential electrode 22A is formed on the side of the other surface (lower surface as shown in FIG. 4). Accordingly, the first active portion 71 is formed in the identical piezoelectric sheet 12*a*. Further, the individual electrode 21B is formed on the side of one surface (surface disposed on the upper side as shown in FIG. 4) of the piezoelectric sheet 12*c*, and the first constant electric potential electrode 22B and the second constant electric potential electrode 23 are alternately formed on the side of the other surface (surface disposed on the lower side as shown in FIG. 4). Accordingly, the first active portions 72, 73, which correspond to the first active portion 71 of the piezoelectric sheet 12*a*, are formed in the piezoelectric sheets 12*b*, 12*c* respectively. Further, the second active portions 71, 72 are formed to range over the piezoelectric sheets 12*a* to 12*c*.

The lengths of the first active portions 71, 72 are longer than that of the first active portion 73 in the nozzle array direction, because the second constant electric potential electrode 22A is longer than the second constant electric potential electrode 22B in the nozzle array direction X.

Figure 5:
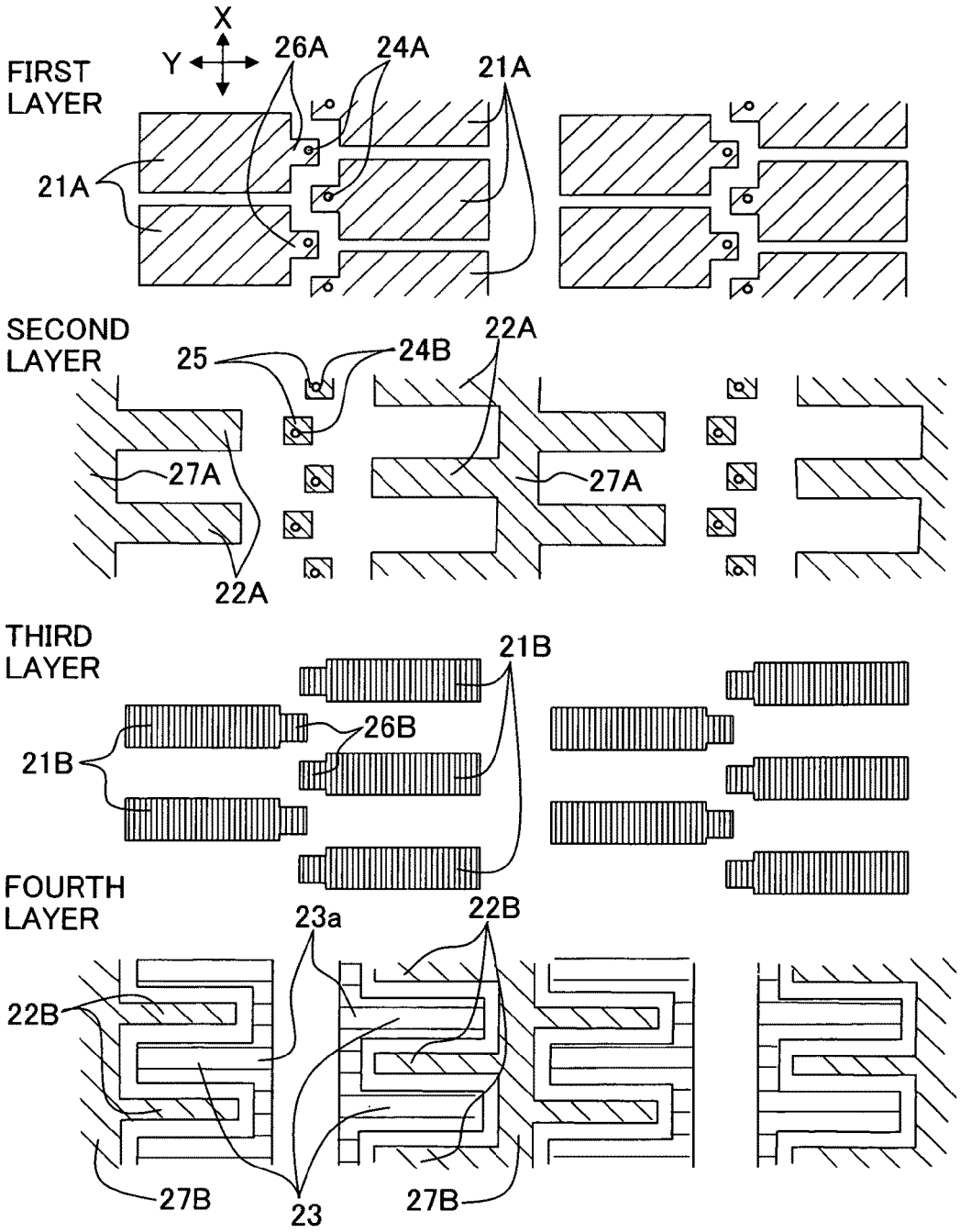
FIG. 5 illustrates the arrangement of electrodes on respective piezoelectric material layers of the piezoelectric actuator.

The electrodes 21A, 21B, 22A, 22B of the respective piezoelectric sheets 12*a* to 12*c* are arranged as shown in FIG. 5 as viewed in a plan view. That is, the individual electrodes 21A (21B) are arranged at constant pitches in the nozzle array direction (X direction) corresponding to the respective pressure chambers 40 on the upper surface side of the piezoelectric sheet 12*a* (12*c*) (first layer, third layer). A plurality of arrays of the individual electrodes 21A (21B) as described above are aligned in the Y direction. The individual electrodes 21A (21B) are formed while being deviated from each other by the half pitch in the X direction in the arrays adjoining in the Y direction. Connecting sections 26A (26B), which are connected to connecting terminals (not shown) of the flexible wired board 13, are formed in a zigzag form for the individual electrodes 21A (21B).

The first constant electric potential electrodes 22A are arranged at constant pitches in the nozzle array direction corresponding to the pressure chambers 40 on the lower surface side (second layer) of the piezoelectric sheet 12*a*. One end of each of them is connected to a common electrode 27A which extends in the nozzle array direction, and the ground electric potential is supplied. Intermediate electrodes 25, which are provided to electrically connect the individual electrodes 21A disposed on the upper surface side of the piezoelectric sheet 12*a* and the individual electrodes 21B disposed on the upper surface side of the piezoelectric sheet 12*c* positioned on the lower side, are formed in a zigzag form between the adjoining pressure chambers 40 (see FIG. 5). In other words, the connecting sections 26A of the individual electrodes 21A are connected to the intermediate electrodes 25 by means of through-holes 24A formed through the piezoelectric sheet 12*a*. The intermediate electrodes 25 are connected to the connecting sections 26B of the individual electrodes 21B by means of other through-holes 24B formed through the piezoelectric sheet 12B. The through-holes 24A, 24B are filled with a conductive liquid to electrically connect the intermediate electrodes 25 and the connecting sections 26A, 26B.

The first constant electric potential electrodes 22B, which are arranged at constant pitches in the nozzle array direction X corresponding to the pressure chambers 40, are formed on the lower surface side of the piezoelectric sheet 12*c*. One end of each of them is connected to a common electrode 27B which extends in the nozzle array direction X, and the ground electric potential is applied. The second constant electric potential electrodes 23 are formed between the first constant electric potential electrodes 22B respectively. One end of each of them is connected to a common electrode 23*a* which extends in the nozzle array direction X, and the ground electric potential is applied.

The first constant electric potential electrode 22B, which is positioned on the side of the pressure chamber 40, has the length in the nozzle array direction X, the length being formed to be longer than that of the first constant electric potential electrode 22A which is separated from the pressure chamber 40.

Figure 6:
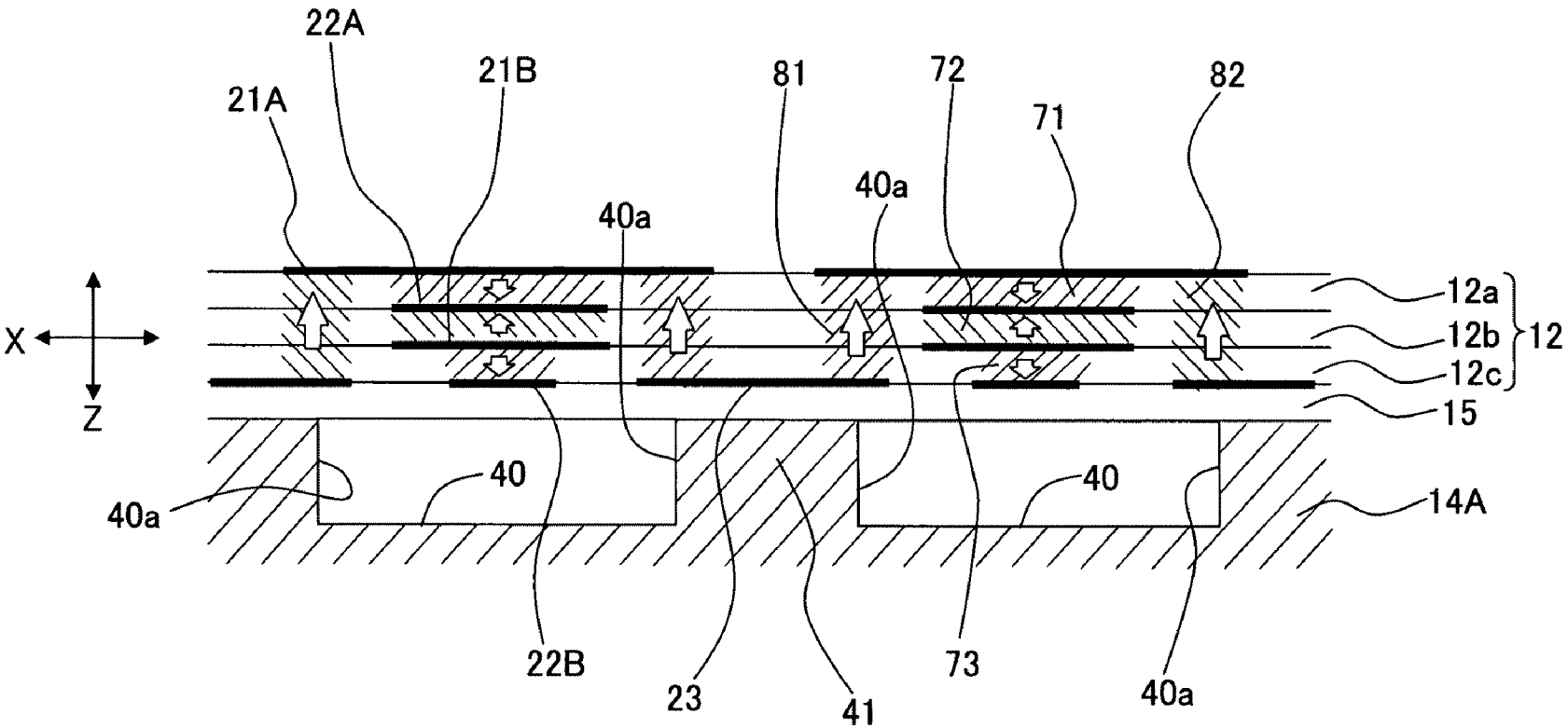
FIG. 6 illustrates the relationship between the direction of polarization and first and second active portions in relation to the first embodiment.

As shown in FIG. 6, the first active portions 71 to 73 are polarized in the predetermined direction in which the voltage is applied and the second electric potential is applied to the individual electrode 21. The second active portions 81, 82 are polarized in the direction opposite to the predetermined direction.

In other words, the first active portions 71 to 73, which are constructed by the piezoelectric sheets (piezoelectric material layers) interposed by the individual electrodes 21A, 21B and the first constant electric potential electrodes 22A, 22B, are polarized in the predetermined direction along with the stacking direction of the individual electrodes 21A, 21B and the first constant electric potential electrodes 22A, 22B. In other words, the first active portions 71 to 73 are polarized in the same direction (direction of polarization) as the direction of the electric field generated by the voltage to be applied when the deformation is caused. The second active portions 81, 82, which are constructed by the piezoelectric sheets (piezoelectric material layers) interposed by the individual electrodes 21A, 21B and the second constant electric potential electrode 23, are polarized in the direction opposite to the predetermined direction along with the stacking direction of the individual electrodes 21A, 21B and the second constant electric potential electrode 23. In other words, the second active portions 81, 82 are polarized in the same direction as the direction of the electric field generated by the voltage to be applied when the deformation is caused. In other words, the direction, in which the voltage is applied, is opposite to the direction of polarization.

The second active portions 81, 82 are polarized in the direction opposite to the predetermined direction along with the stacking direction of the individual electrodes 21A, 21B and the second constant electric potential electrode 23. The spacing distance between the individual electrode 21A and the second constant electric potential electrode 23 to interpose the second active portions 81, 82 amounts to a thickness of three of the piezoelectric sheets. In other words, the spacing distance is larger than the spacing distance (corresponding to a thickness of one piezoelectric sheet) between the individual electrodes 21A, 21B and the first constant electric potential electrodes 22A, 22B to interpose the first active portions 71 to 73. Therefore, when the voltage is applied during the driving, then the electric field intensity is low, and the polarization deterioration is avoided in this case.

TABLE 1

| Type of electrode | Voltage applied during polarization | Voltage applied during driving |
|---|---|---|
| Individual electrodes 21A, 21B | 50 V | 20 V |
| First constant electric potential electrodes 22A, 22B | 0 V | 0 V |
| Second constant electric potential electrode 23 | 150 V | 0 V |

As shown in Table 1, the first constant electric potential electrodes 22A, 22B and the second constant electric potential electrode 23 are always at the first electric potential (ground electric potential). The first electric potential (ground electric potential) and the second electric potential (positive electric potential: 20V) are selectively applied to the individual electrodes 21A, 21B in order to change the volume of the pressure chamber 40. Therefore, when the second electric potential (positive electric potential) is applied to the individual electrodes 21A, 21B, the voltage is applied to both of the first active portions 71 to 73 and the second active portions 81, 82. As shown in Table 1, the voltage, which is applied between the electrodes during the driving, is considerably smaller than the voltage which is applied during the polarization. The polarization deterioration is suppressed, which would be otherwise caused by repeatedly applying the voltage between the electrodes during the driving.

When the electrodes 21A, 21B, 22A, 22B, 23 are arranged as described above, the electric field which is generated by the voltage to be applied by the voltage-applying mechanism is in the same direction as the direction of polarization to the first active portions 71 to 73 during the driving in which the second electric potential (positive electric potential) is applied to the individual electrodes 21. Owing to the piezoelectric lateral effect, the first active portions 71 to 73 are elongated in the stacking direction Z directed toward the pressure chamber 40, they are shrunk in the nozzle array direction X perpendicular to the stacking direction Z, and they are deformed to protrude in the direction into the pressure chamber 40. On the other hand, the top plate 15 is not shrunk spontaneously, because the top plate 15 is not affected by the electric field. Therefore, the difference arises in the strain in the direction perpendicular to the direction of polarization between the piezoelectric sheet 12*c* positioned on the upper side and the top plate 15 positioned on the lower side. This fact is combined with the fact that the top plate 15 is fixed to the cavity plate 14A, and thus the piezoelectric sheet 12*c* and the top plate 15 intend to be deformed so that they protrude toward the pressure chamber 40 (unimorph deformation). Therefore, the volume of the pressure chamber 40 is decreased, the pressure of the ink is increased, and the ink is discharged from the nozzle hole 16*a*.

Figure 7:
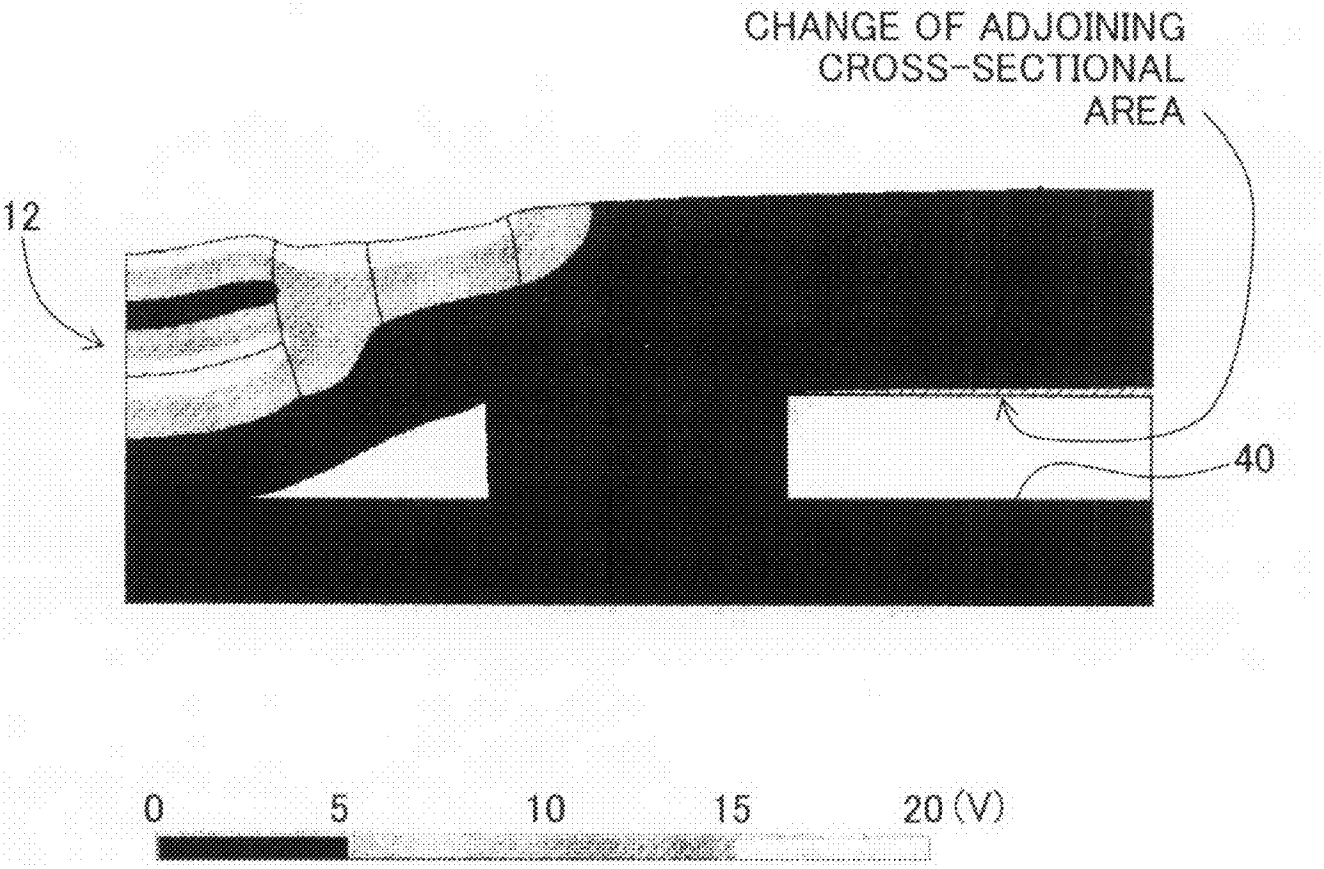
FIG. 7 illustrates the volume change of the pressure chamber when the voltage is applied to the first active portion.

In this situation, the second active portions 81, 82 are in such a state that the electric field generated by the applied voltage is in the direction opposite to the direction of polarization. The second active portions 81, 82 intend to be shrunk in the stacking direction Z directed toward the pressure chamber 40, and they intend to be elongated in the nozzle array direction X perpendicular to the stacking direction Z. Therefore, the influence, which is caused by the shrinkage deformation of the first active portions 71 to 73 in the nozzle array direction X, is suppressed from being propagated to the adjoining pressure chambers 40, and the crosstalk is suppressed. In other words, as shown in FIG. 7, the influence of the deformation of the first active portions 71 to 73 is canceled by the deformation of the second active portions 81, 82, and the influence is hardly exerted on the adjacent pressure chamber 40. The crosstalk is suppressed.

The second active portions 81, 82 intend to be elongated in the nozzle array direction X, which facilitate the tendency of the deformation of the first active portions 71 to 73 so that the first active portions 71 to 73 protrude toward the pressure chamber 40. This not only suppresses the crosstalk but also contributes to the increase in the volume change of the pressure chamber 40.

Figure 13:
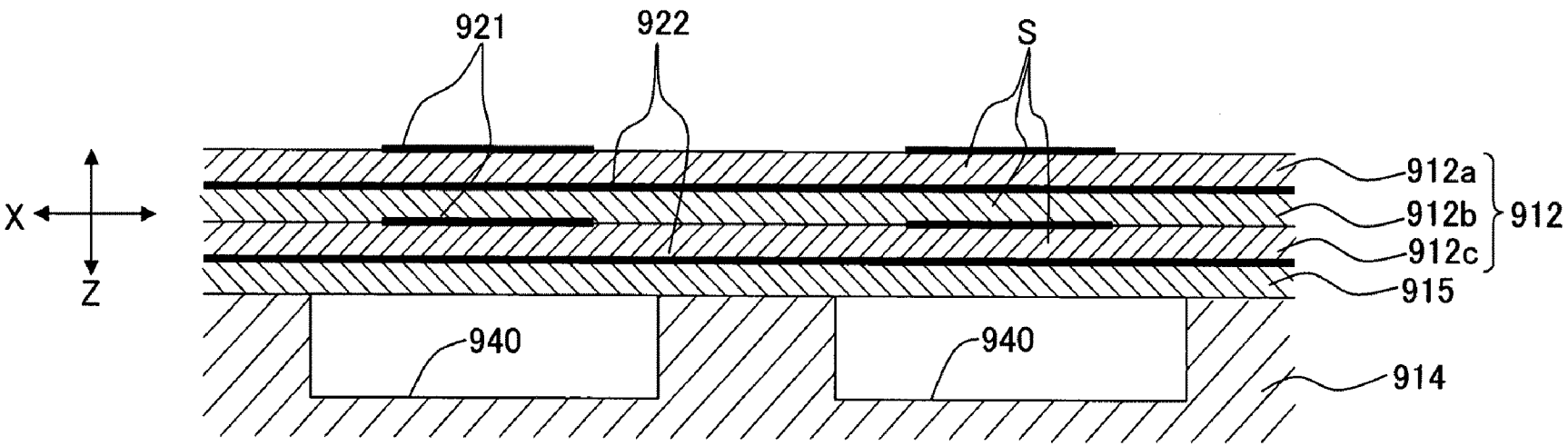
FIG. 13 shows a schematic sectional view concerning an exemplary conventional technique.
Figure 14:
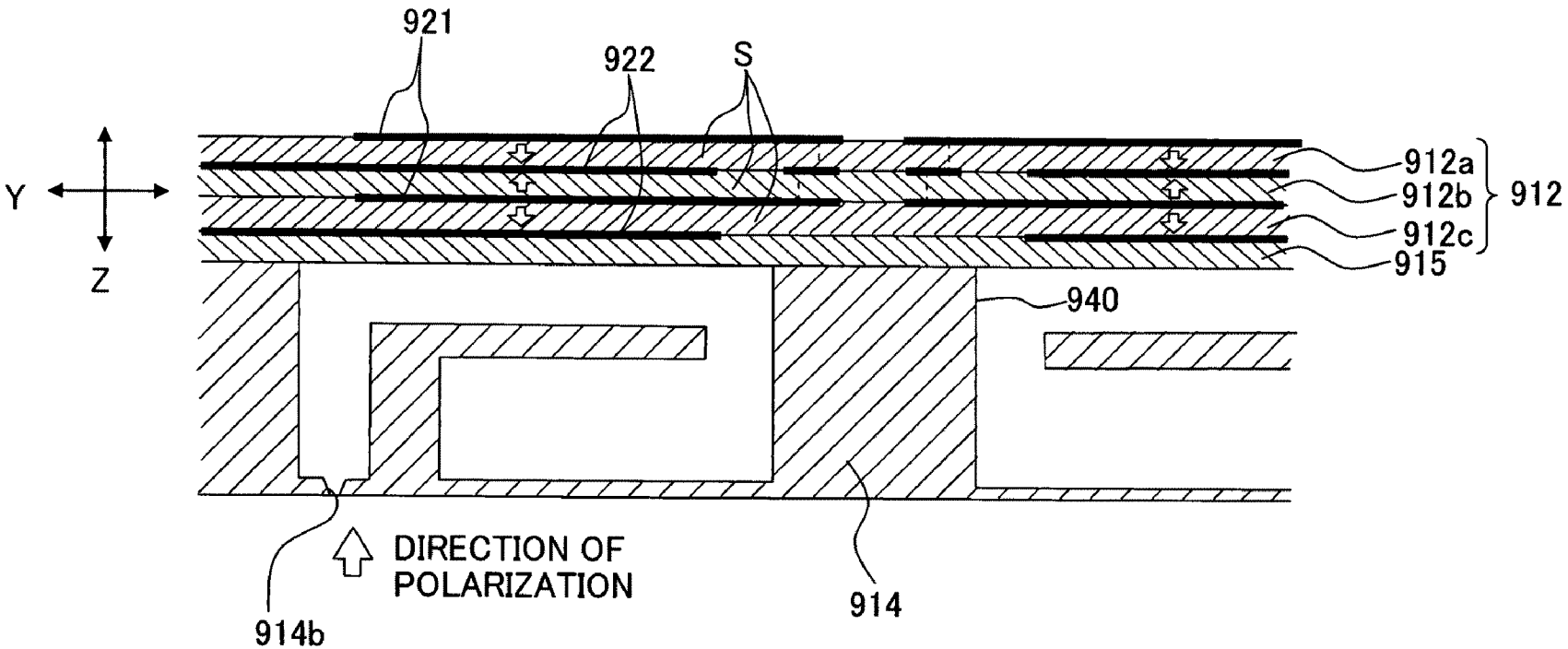
FIG. 14 illustrates the relationship between the direction of polarization and first and second active portions concerning the exemplary conventional technique.
Figure 15:
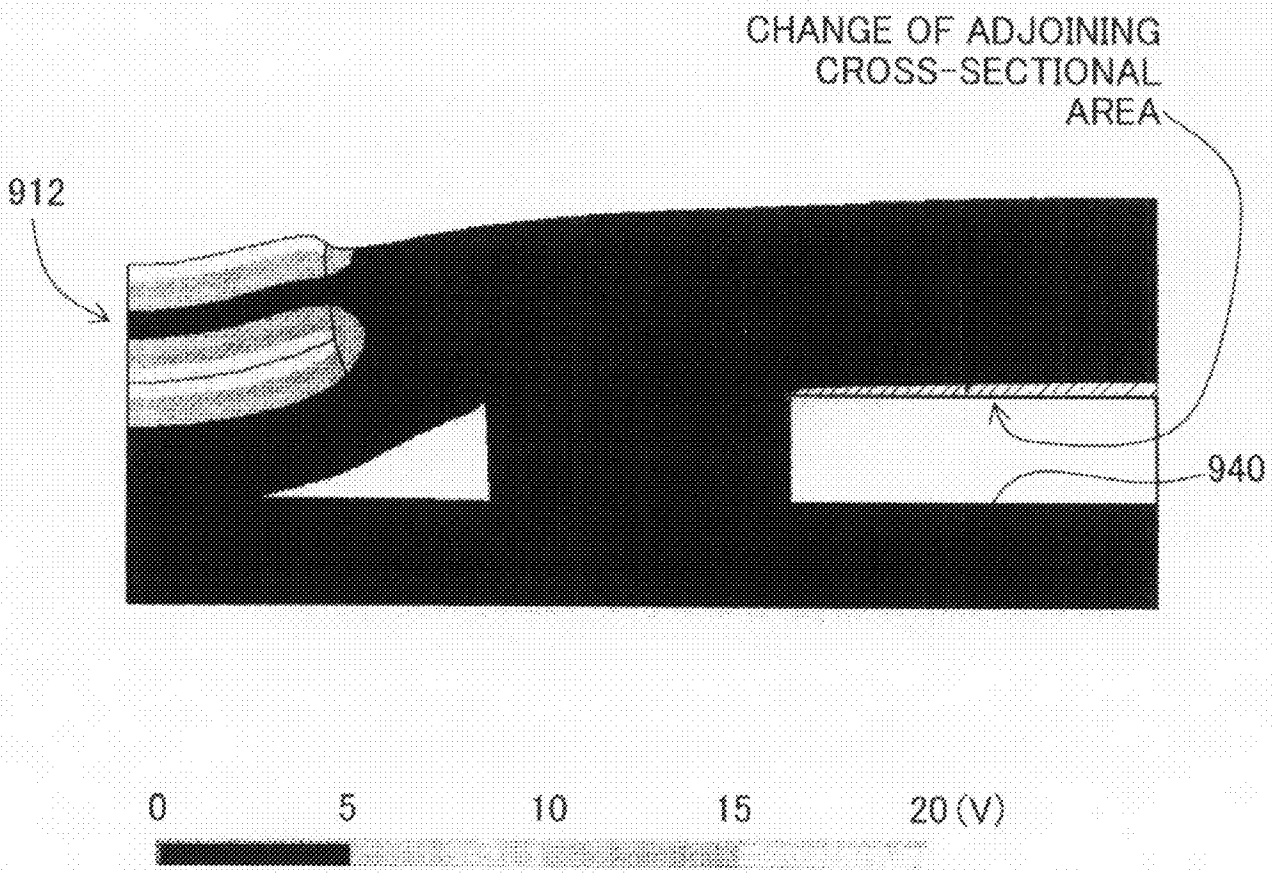
FIG. 15 illustrates the volume change of the pressure chamber when the voltage is applied to the active portion of the exemplary conventional technique.

The ratio of the change of the cross-sectional area of the adjoining pressure chamber was determined for the first embodiment and the exemplary conventional technique (see FIGS. 13 and 14). As a result, as shown in Table 2, the following fact is appreciated. That is, the ratio of the change of the cross-sectional area is 24% in the case of the exemplary conventional technique, while the ratio of the change of the cross-sectional area is 11% in the case of the first embodiment. The ratio of the change is reduced approximately by half in the case of the first embodiment as compared with the exemplary conventional technique. The effect to suppress the crosstalk is exhibited.

TABLE 2

| | Electrode width (μm) | | | Change of cross-sectional area ($\mu m^2$) | Change of adjoining cross-sectional area ($\mu m^2$) | Ratio of adjoining change |
|---|---|---|---|---|---|---|
| | Individual electrode | First constant electric potential electrode | Second constant electric potential electrode | | | |
| Exemplary conventional technique | 250 | full | — | 5.82 | 1.38 | 24% |

TABLE 2-continued

| | Electrode width (μm) | | | Change of cross-sectional area ($\mu m^2$) | Change of adjoining cross-sectional area ($\mu m^2$) | Ratio of adjoining change |
|---|---|---|---|---|---|---|
| | Individual electrode | First constant electric potential electrode | Second constant electric potential electrode | | | |
| First embodiment | 408 | 200, 120 | 188 | 5.65 | 0.60 | 11% |
| Second embodiment | 408 | 200 | 200 | 6.05 | 0.78 | 13% |

Figure 8:
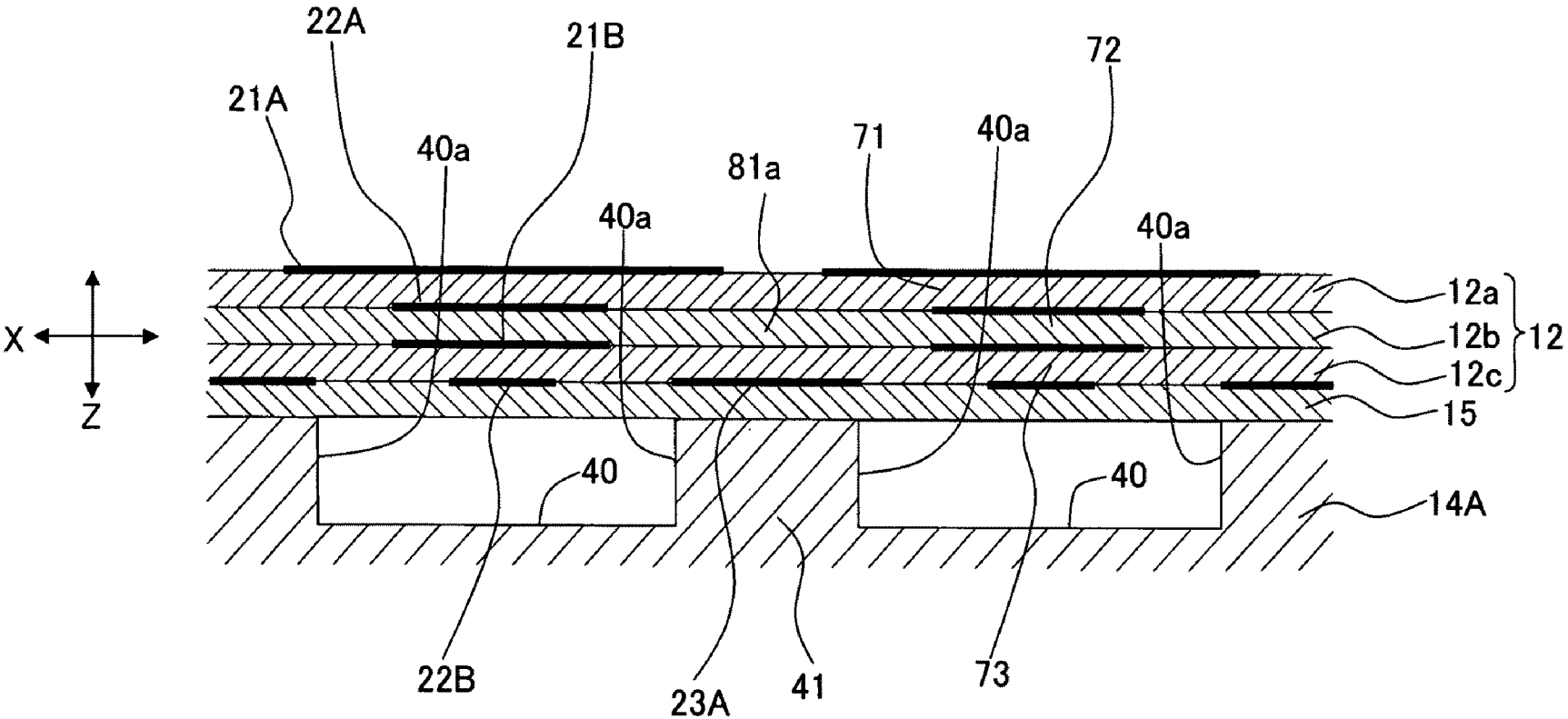
FIG. 8 shows a modified embodiment of the first embodiment, which is equivalent to FIG. 4.

In the first embodiment described above, the second active portions 81, 82 are arranged to range over between the area corresponding to the portion disposed on the outer circumferential side as compared with the central portion of the pressure chamber 40 in the nozzle array direction X (area disposed inside the outer circumferential edge 40*a* of the pressure chamber 40) and the area corresponding to the column portion 41. However, it is also possible to adopt a construction as shown in FIG. 8. That is, the construction or arrangement may be made such that the second constant electric potential electrode 23A is arranged in only an area which corresponds to the column portion 41 between the pressure chamber 40 and the adjoining pressure chamber 40 and which is disposed outside the outer circumferential edge 40*a* of the pressure chamber 40 so that the second active portion 81*a*, 82*a* exists in only the area which corresponds to the column portion 41. In this case, even when the voltage is applied to the second active portions 81*a*, 82*a*, and the second active portions 81*a*, 82*a* are deformed, then there is no contribution to the expansion of the volume of the pressure chamber 40. However, the effect to suppress the crosstalk is exhibited.

Figure 9:
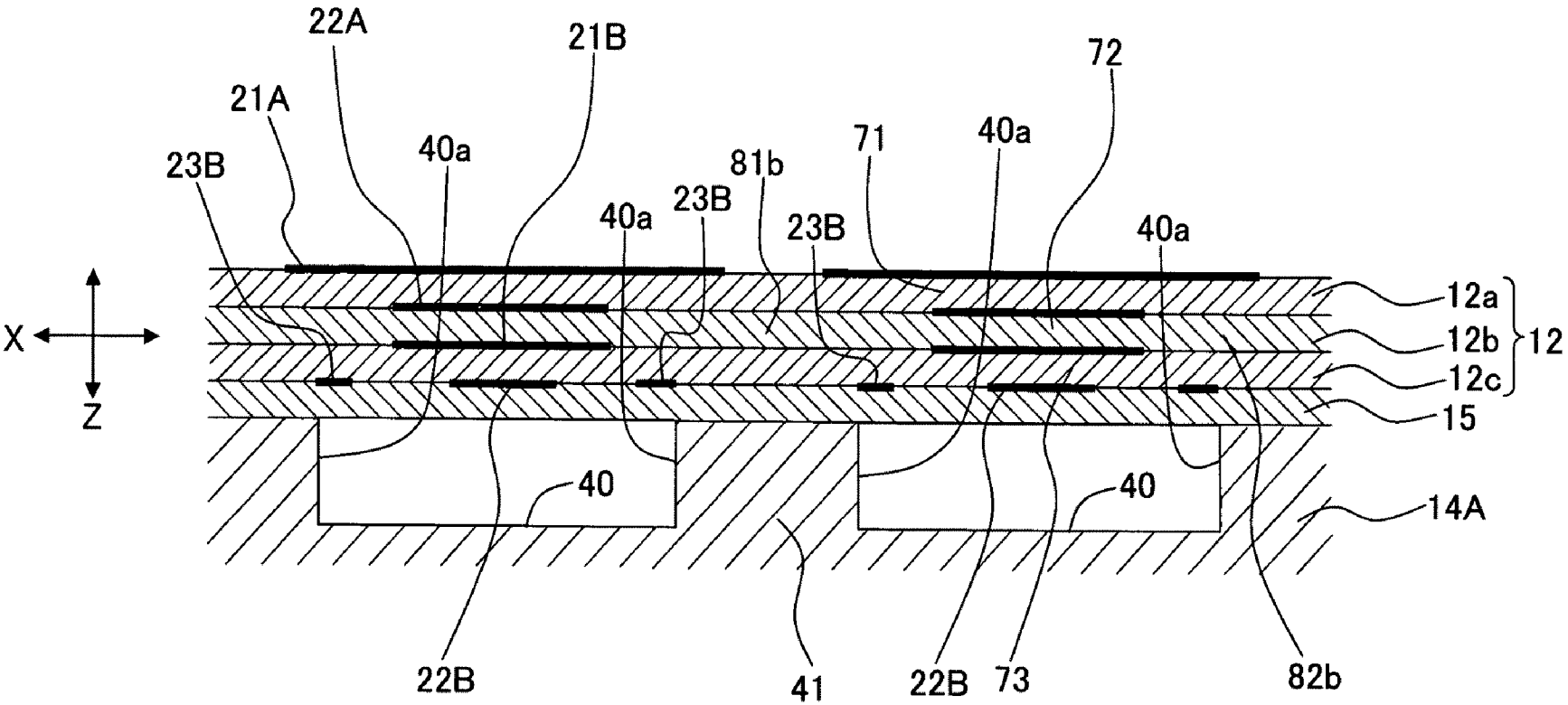
FIG. 9 shows another modified embodiment of the first embodiment, which is equivalent to FIG. 4.

On the contrary, as shown in FIG. 9, it is also possible to adopt a construction such that the second active portion 81*b*, 82*b* exists in only the area corresponding to the portion disposed on the outer circumferential side of the pressure chamber 40. That is, the second constant electric potential electrode 23B can be provided in only the area corresponding to the portion disposed on the outer circumferential side as compared with the central portion of the pressure chamber 40, irrelevant to the area corresponding to the column portion 41. In this case, the length of the second active portion 81*b*, 82*b* in the nozzle array direction is shortened as compared with the case described above (see FIG. 4) in which the second active portion 81, 82 is arranged to range over between the area corresponding to the portion disposed on the outer circumferential side as compared with the central portion of the pressure chamber 40 and the area corresponding to the column portion 41. Therefore, although this construction is inferior in the degrees of the effect to contribute to the volume change and the effect to suppress the crosstalk, this construction is the same as that described above in that these effects are exhibited.

Each of the individual electrodes 21A, 21B and the constant electric potential electrodes 22A, 22B, 23 is formed on the sheet surface of the piezoelectric sheet, for example, by means of the screen printing. In this procedure, when the first and second constant electric potential electrodes 22B, 23 are alternately formed in the nozzle array direction X on the identical surface as in the first embodiment described above, it is impossible to excessively decrease the spacing distance between the electrodes in order to avoid the short circuit formation. Therefore, it is impossible to lengthen the lengths of the electrodes in the nozzle array direction. When the lengths of the electrodes in the nozzle array direction cannot be lengthened, it is impossible to greatly deform the piezoelectric sheet (piezoelectric material layer), which is disadvantageous to obtain the high discharge efficiency. However, as described in the following second embodiment, when a construction is adopted such that a portion, in which two piezoelectric sheets having different thicknesses are stacked, is provided at least partially, it is also possible to lengthen the lengths.

Second Embodiment

Figure 10:
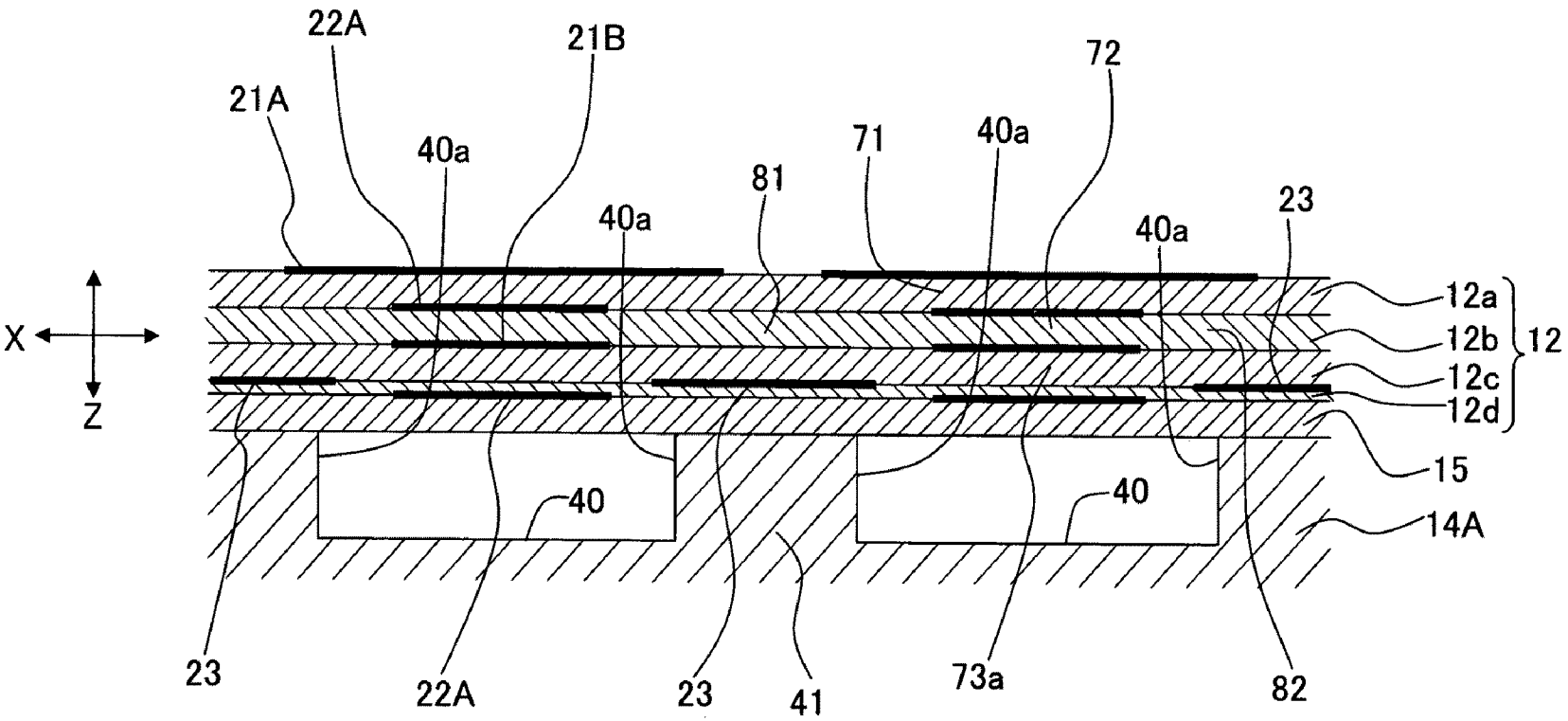
FIG. 10 shows a second embodiment, which is equivalent to FIG. 4.

As shown in FIG. 10, for example, the piezoelectric sheet 12*c* (upper piezoelectric sheet disposed on the upper side) is provided on the upper side of the top plate 15 via a piezoelectric sheet 12*d* (lower piezoelectric sheet disposed on the lower side) which functions as an insulating layer. The piezoelectric sheet 12*d* is thinner than the upper piezoelectric sheet 12*c*. The first constant electric potential electrode 22A is formed on the lower surface side of the piezoelectric sheet 12*d* to make isolation from the second constant electric potential electrode 23 disposed on the upper surface side. Accordingly, the length of the first constant electric potential electrode 22A is lengthened as compared with the construction of the first embodiment. The piezoelectric sheet 12*d* is formed of the same material as that of the piezoelectric sheets 12*a* to 12*c*.

Accordingly, the first active portions 71, 72, 73*a* are formed to correspond to the central portion of each of the pressure chambers 40, and the second active portions 81, 82 are formed to correspond to the portions disposed on the outer circumferential sides thereof.

When the construction is adopted as described above, the first constant electric potential electrode 22A and the second constant electric potential electrode 23 can be isolated from each other by interposing, as the insulating layer, the lower piezoelectric sheet 12*d* which has the thin thickness. Therefore, the first constant electric potential electrode 22A and the second constant electric potential electrode 23 can be easily formed as the electrodes 22A, 23 having the long lengths which are advantageous to obtain the high discharge efficiency, while securing the large volume change of the pressure chamber 40, for example, by means of the screen printing. Further, the overall thickness is not thickened so much as well, because it is enough that the thickness of the piezoelectric sheet 12*d* is thinner than those of the other piezoelectric sheets 12*a* to 12*c*.

The following fact is appreciated as shown in Table 2 in the case of the second embodiment as well. That is, the ratio of the change of the cross-sectional area of the adjoining pressure chamber is 13%. The ratio of the change is reduced approximately by half as compared with the exemplary conventional technique in the same manner as in the first embodiment. The effect to suppress the crosstalk is exhibited.

Third Embodiment

In this embodiment, the piezoelectric actuator has such a stacked structure that the thicknesses of two piezoelectric sheets stacked separately from the pressure chamber 40 are thinner than the thickness of the other piezoelectric sheet. Therefore, the construction of the electrodes is symmetrical vertically, and the lower individual electrode is longer than the pressure chamber, as compared with the second embodiment.

Figure 11:
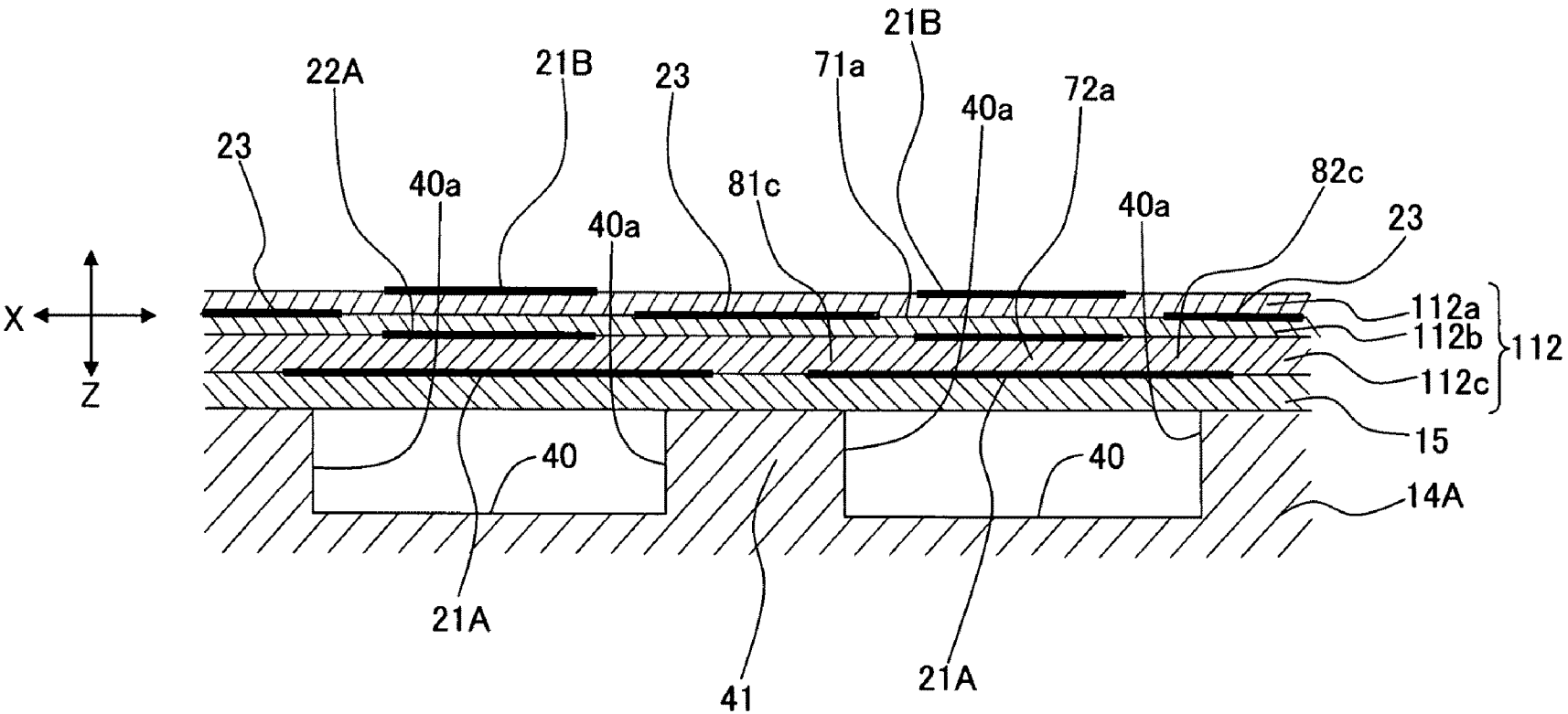
FIG. 11 shows a third embodiment, which is equivalent to FIG. 4.

As shown in FIG. 11, the sheet thicknesses of the two piezoelectric sheets 112*a*, 112*b* stacked most separately from the pressure chamber 40 are thinned to have thicknesses of approximately half of the sheet thickness of the other piezoelectric sheet 12*c*. The individual electrodes 21B are formed at constant spacing distances on the side of one surface (upper surface) of the upper piezoelectric sheet 112*a* (piezoelectric sheet), and the second constant electric potential electrodes 23 are formed at constant spacing distances respectively on the side of the other surface (lower surface) (i.e., between the piezoelectric sheets 112*a*, 112*b*). The first constant electric potential electrodes 22A are formed on the lower side of the piezoelectric sheet 112*b* (i.e., on the upper surface side of the piezoelectric sheet 12*c*), and the individual electrodes 21A are formed on the side of the lower surface. The electric isolation is effected between the individual electrode 21B and the second constant electric potential electrode 23 and between the second constant electric potential electrode 23 and the first constant electric potential electrode 22A by the aid of the piezoelectric sheets 112*a*, 112*b* (insulating layers).

Accordingly, the first active portions 71*a*, 72*a* are formed to correspond to the central portion of each of the pressure chambers 40, and the second active portions 81*c*, 82*c* are formed to correspond to the portions disposed on the outer circumferential sides thereof.

As described above, when the construction is adopted such that the individual electrode 21B, the first constant electric potential electrode 22A, and the second constant electric potential electrode 23 are isolated while interposing the piezoelectric sheets 112*a*, 112*b*, it is possible to lengthen the length in the nozzle array direction of the first constant electric potential electrode 22A formed between the piezoelectric sheet 112*a* and the piezoelectric sheet 112*b*. The electrode arrangement is realized, which is advantageous to increase the volume change of the pressure chamber 40.

It is not necessarily indispensable that the second active portions are provided on the both sides of the first active portions as in the first to third embodiments described above. When it is enough that the effect to suppress the crosstalk is exhibited for only one side of the first active portion, it is also possible to provide the second active portion on only one side of the first active portion as described in the following fourth embodiment.

Fourth Embodiment

In this embodiment, an individual electrode is formed to range over a part of the area corresponding to the pressure chamber 40 and the area corresponding to the column portion 41 so that both of the areas are occupied thereby.

Figure 12:
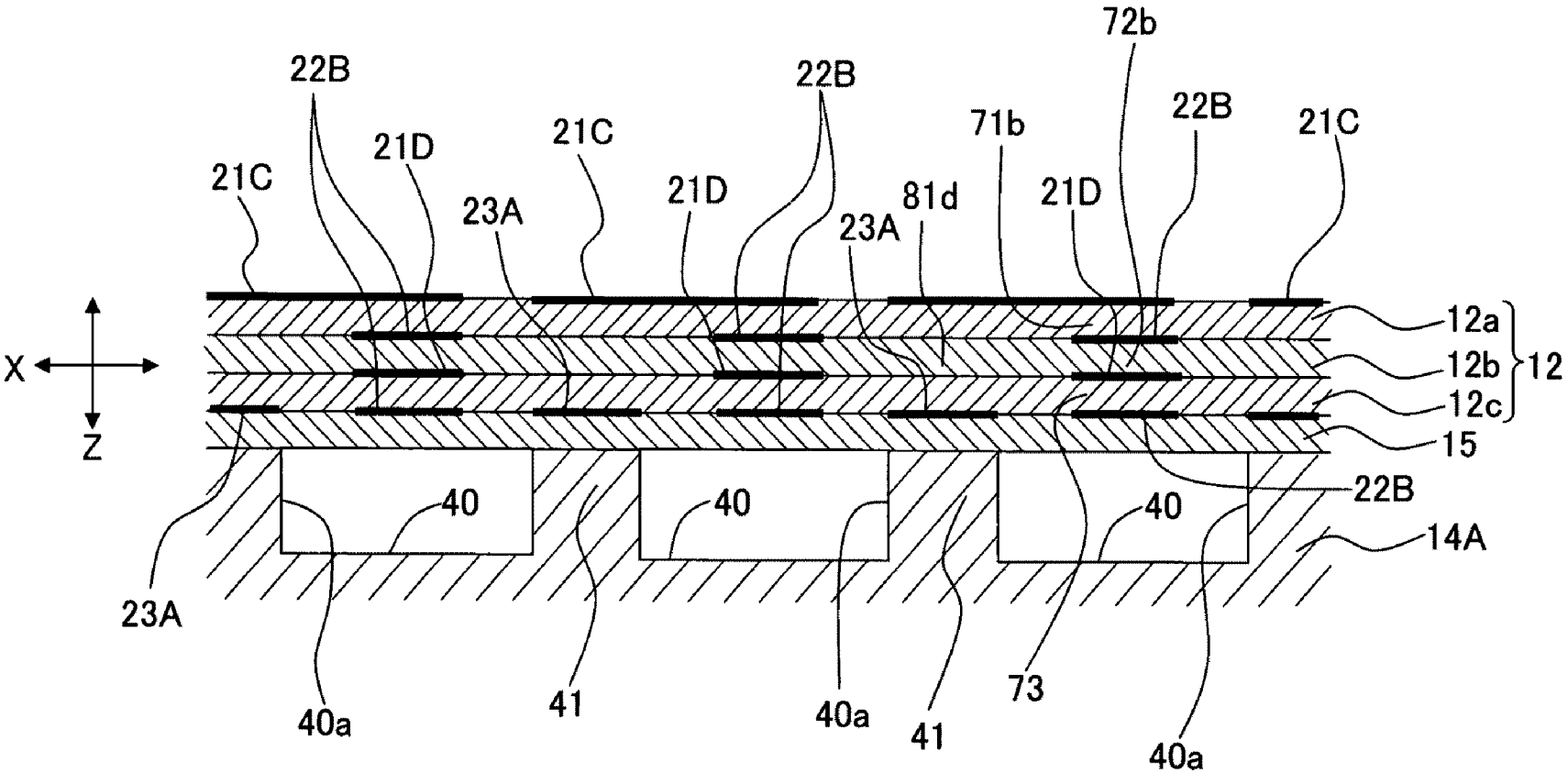
FIG. 12 shows a fourth embodiment, which is equivalent to FIG. 4.

As shown in FIG. 12, the individual electrode 21C is formed on the side of one surface (upper surface) of the piezoelectric sheet 12*a*, and the first constant electric potential electrode 22B is formed to correspond to one side portion of the individual electrode 21C on the side of the other surface (lower surface). The individual electrode 21D is formed on the upper surface side of the piezoelectric sheet 12*c*, and the first constant electric potential electrode 22B is formed on the lower surface side. The second constant electric potential electrode 23A, which corresponds to the other side portion of the individual electrode 21C, is formed on the lower surface side of the piezoelectric sheet 12*c*.

Accordingly, the first active portions 71*a*, 72*a*, 73 are formed to correspond to the central portion of each of the pressure chambers 40, and the second active portion 81*d* is formed to correspond to the portion disposed on one outer circumferential side thereof.

By doing so, the effect to suppress the crosstalk is exhibited for only the side on which the second active portion 81 is arranged. However, it is unnecessary to provide the second active portions on the both sides of the first active portion. Therefore, this construction is advantageous to realize a higher density as compared with the constructions of the first to third embodiments.

The present invention is not limited to the embodiments explained above. The present invention can be also carried out while being modified as follows.

In the second embodiment described above, the portion, in which the upper piezoelectric sheet 12*c* and the lower piezoelectric sheet 12*d* thinner than the upper piezoelectric sheet are stacked, is provided on only the side of the pressure chamber 40. However, it is a matter of course to adopt such a construction that the same or equivalent portion is also provided for any other part or parts. Similarly, in the third embodiment, the portion, in which the two piezoelectric sheets 112*a*, 112*b* having the thicknesses thinner than that of the other piezoelectric sheet 12*c* are stacked, is provided on only the side separated farthest from the pressure chamber 40. However, it is also allowable to adopt such a construction that the same or equivalent portion is also provided for any other part or parts.

The foregoing embodiments have been explained assuming that the liquid droplet discharge apparatus is the recording apparatus based on the ink-jet system. However, the present invention is not limited thereto. The present invention is also applicable, for example, to any other liquid droplet discharge apparatus in which a coloring liquid is applied as minute liquid droplets, or a conductive liquid is discharged to form a wiring pattern.

Those applicable as the recording medium are not limited to only the recording paper, which also include various materials such as resins and cloths. Those applicable as the liquid to be discharged are not limited to only the ink, which also include various materials such as coloring liquids and functional liquids.

What is claimed is:

1. A liquid droplet discharge apparatus which discharges liquid droplets of a liquid, the liquid droplet discharge apparatus comprising:

a liquid droplet discharge head including:

a cavity unit which has a plurality of pressure chambers arranged regularly in the cavity unit and a piezoelectric actuator which is joined to the cavity unit and which selectively discharges the liquid in each of the pressure chambers, the piezoelectric actuator having a piezoelectric material layer which covers the plurality of pressure chambers continuously;

a plurality of individual electrodes which correspond to the pressure chambers respective; and first and second constant electric potential electrodes which correspond to each of the pressure chambers; and wherein the piezoelectric material layer includes:

a first active portion, which is sandwiched by one of the individual electrodes and the first constant electric potential electrode, and which corresponds to a central portion of each of the pressure chambers; and a second active portion, which is sandwiched by one of the individual electrodes and the second constant electric potential electrode, and which corresponds to a portion, of each of the pressure chambers, located on an outer circumferential side with respect to the central portion of each of the pressure chambers; and a voltage-applying mechanism which applies a voltage to the piezoelectric actuator;

wherein the first active portion is polarized in a predetermined direction along with a stacking direction of each of the individual electrodes and the first constant electric potential electrode;

wherein the second active portion is polarized in a direction opposite to the predetermined direction along with the stacking direction of each of the individual electrodes and the second constant electric potential electrode; and wherein the voltage-applying mechanism selectively applies, to the individual electrodes, a first electric potential and a second electric potential different from the first electric potential, and the voltage-applying mechanism applies the first electric potential to the first and second constant electric potential electrodes.

2. The liquid droplet discharge apparatus according to claim 1;

wherein the piezoelectric material layer has first, second, and third piezoelectric sheets which are stacked in this order;

wherein the individual electrode has a first individual electrode which is arranged on a lower surface of the third piezoelectric sheet and a second individual electrode which is arranged on an upper surface of the first piezoelectric sheet;

wherein the first constant electric potential electrode is arranged between the second and third piezoelectric sheets;

wherein the second constant electric potential electrode is arranged between the first and second piezoelectric sheets; and wherein a sum of thicknesses of the first and second piezoelectric sheets is same as a thickness of the third piezoelectric sheet.

3. The liquid droplet discharge apparatus according to claim 1;

wherein a spacing distance between each of the individual electrodes and the second constant electric potential electrode to sandwich the second active portion therebetween is greater than a spacing distance between each of the individual electrodes and the first constant electric potential electrode to sandwich the first active portion therebetween.

4. The liquid droplet discharge apparatus according to claim 1;

wherein the piezoelectric material layer includes two piezoelectric sheets which are stacked and which have different thicknesses.

5. The liquid droplet discharge apparatus according to claim 4;

wherein the piezoelectric sheets include an upper piezoelectric sheet and a lower piezoelectric sheet thinner than the upper piezoelectric sheet, the upper piezoelectric sheet being stacked onto the lower piezoelectric sheet; and wherein the second constant electric potential electrode is arranged between the upper piezoelectric sheet and the lower piezoelectric sheet, and the first constant electric potential electrode is arranged at a position below the lower piezoelectric sheet.

6. The liquid droplet discharge apparatus according to claim 4;

wherein the piezoelectric material layer has another piezoelectric sheet which is different from the two piezoelectric sheets;

wherein the stacked two piezoelectric sheets are thinner than the another piezoelectric sheet; and wherein each of the individual electrodes is arranged on an upper piezoelectric sheet among the two piezoelectric sheets, the second constant electric potential electrode is arranged between the two piezoelectric sheets, and the first constant electric potential electrode is arranged at a position below the lower piezoelectric sheet.

7. The liquid droplet discharge apparatus according to claim 1;

wherein the second constant electric potential electrode is arranged corresponding to a column portion between adjacent pressure chambers among the plurality of pressure chambers, the column portion being located at the outside of an outer circumferential edge of each of the pressure chambers.

8. The liquid droplet discharge apparatus according to claim 1;

wherein the second active portion, which corresponds to each of the pressure chambers, is arranged on only one side of each of the pressure chambers.

9. The liquid droplet discharge apparatus according to claim 1;

wherein the second active portion includes an area located inside an outer circumferential edge of each of the pressure chambers.

10. The liquid droplet discharge apparatus according to claim 1;

wherein the second active portion, which correspond to each of the pressure chambers, is arranged to be on both sides of each of the pressure chambers.

11. A liquid droplet discharge apparatus which discharges liquid droplets of a liquid, the liquid droplet discharge apparatus comprising:

a liquid droplet discharge head including:

a cavity unit which has a plurality of pressure chambers arranged regularly in the cavity unit and a piezoelectric actuator which is joined to the cavity unit and which selectively discharges the liquid in each of the pressure chambers, the piezoelectric actuator having a piezoelectric material layer which covers the pressure chambers;

a plurality of individual electrodes which correspond to the pressure chambers respectively; and first and second constant electric potential electrodes which correspond to each of the pressure chambers; and wherein the piezoelectric material layer includes:

a first active portion, which is sandwiched by one of the individual electrodes and the first constant electric potential electrode, and which corresponds to a central portion of each of the pressure chambers; and a second active portion, which is sandwiched by one of the individual electrodes and the second constant electric potential electrode and which corresponds to a portion, of each of the pressure chambers, located on an outer circumferential side with respect to the central portion of each of the pressure chambers; and a voltage-applying mechanism which applies a voltage to the piezoelectric actuator;

wherein the first active portion is polarized in a predetermined direction along with a stacking direction of each of the individual electrodes and the first constant electric potential electrode;

wherein the second active portion is polarized in a direction opposite to the predetermined direction along with the stacking direction of each of the individual electrodes and the second constant electric potential electrode;

wherein the voltage-applying mechanism selectively applies, to the individual electrodes, a first electric potential and a second electric potential different from the first electric potential, and the voltage-applying mechanism applies the first electric potential to the first and second constant electric potential electrodes;

wherein the piezoelectric material layer has first, second, and third piezoelectric sheets which are stacked in this order;

wherein each of the individual electrodes has a first individual electrode which is arranged on an upper surface of the first piezoelectric sheet and a second individual electrode which is arranged between the second and third piezoelectric sheets;

wherein the first constant electric potential electrode has a first electrode section which is arranged between the first and second piezoelectric sheets corresponding to each of the pressure chambers and a second electrode section which is arranged below the third piezoelectric sheet; and wherein the second constant electric potential electrode is formed below the third piezoelectric sheet corresponding to each of the pressure chambers.

12. The liquid droplet discharge apparatus according to claim 11;

wherein the piezoelectric material layer further includes a fourth piezoelectric sheet which is stacked below the third piezoelectric sheet and which is thinner than the first to third piezoelectric sheets; and wherein the second electrode section is arranged on one surface of the fourth piezoelectric sheet, and the second constant electric potential electrode is arranged on the other surface of the fourth piezoelectric sheet.

13. The liquid droplet discharge apparatus according to claim 11;

wherein the first and second individual electrodes are electrically connected by a conductive material filled into through-holes formed through the first and second piezoelectric sheets; and wherein the first and second electrode sections of the first constant electric potential electrode are electrically connected by the conductive material filled into through-holes formed through the second and third piezoelectric sheets.

14. A liquid droplet discharge apparatus which discharges liquid droplets of a liquid, the liquid droplet discharge apparatus comprising:

a liquid droplet discharge head including:

a cavity unit which has a plurality of pressure chambers arranged regularly in the cavity unit and a piezoelectric actuator which is joined to the cavity unit and which selectively discharges the liquid in each of the pressure chambers;

wherein the piezoelectric actuator having has a piezoelectric material layer which covers the plurality of pressure chambers continuously; and wherein the piezoelectric material layer includes:

a first active portion which corresponds to a central portion of each of the pressure chambers; and a second active portion which corresponds to a portion, of each of the pressure chambers, located on an outer circumferential side with respect to the central portion of each of the pressure chambers; and a voltage-applying mechanism which applies a voltage to the first active portion and applies a voltage to the second active portion;

wherein the first active portion is polarized in a direction which is same as a direction of an electric field generated by a voltage applied to the first active portion, and the second active portion is polarized in a direction which is opposite to the direction of an electric field generated by a voltage applied to the second active portion.

15. The liquid droplet discharge apparatus according to claim 14;

wherein the second active portion includes an area located inside an outer circumferential edge of each of the pressure chambers.

16. A liquid droplet discharge head which discharges liquid droplets of a liquid, the liquid droplet discharge head comprising:

a cavity unit which has a plurality of pressure chambers arranged regularly in the cavity unit; and a piezoelectric actuator which is joined to the cavity unit and which selectively discharges the liquid in each of the pressure chambers;

wherein the piezoelectric actuator including includes:

a piezoelectric material layer which covers the plurality of pressure chambers continuously, the piezoelectric material layer having;

a first active portion which corresponds to a central portion of each of the pressure chambers; and a second active portion which corresponds to a portion, of each of the pressure chambers, located on an outer circumferential side with respect to the central portion of each of the pressure chambers;

an individual electrode which is formed to cover an area, of the piezoelectric material layer, corresponding to the first active portion and an area, of the piezoelectric material layer, corresponding to the second active portion so that both of the areas arc occupied by the individual electrode;

a first constant electric potential electrode which is formed to occupy the area of the piezoelectric material layer corresponding to the first active portion; and a second constant electric potential electrode which is formed to occupy the area of the piezoelectric material layer corresponding to the second active portion;

wherein the first active portion is polarized in a direction from the individual electrode to the first constant electric potential electrode, and the second active portion is polarized in a direction from the second constant electric potential electrode to the individual electrode.

* * * * *